US006129094A

United States Patent [19]

Moll et al.

[11] Patent Number: 6,129,094

[45] Date of Patent: Oct. 10, 2000

[54] METHOD OF HIGH PRESSURE CLEANING

[75] Inventors: Frank J. Moll, Canton; Terry Crock, Massillon, both of Ohio

[73] Assignee: Valley Systems, Inc., Canal Fulton, Ohio

[21] Appl. No.: 09/137,994

[22] Filed: Aug. 21, 1998

Related U.S. Application Data

[63] Continuation-in-part of application No. 08/893,729, Jul. 11, 1997, Pat. No. 5,991,968.

[51] Int. Cl.[7] ..... B08B 3/02; B08B 3/08; B08B 5/04; B08B 9/093

[52] U.S. Cl. ..... 134/21; 134/22.1; 134/22.18; 134/22.19; 134/24; 134/26; 134/38

[58] Field of Search ..... 134/21, 38, 22.1, 134/22.18, 22.19, 24, 26, 2

[56] References Cited

U.S. PATENT DOCUMENTS

| | | | |
|---|---|---|---|
| 3,916,568 | 11/1975 | Rose et al. | 51/8 R |
| 4,107,816 | 8/1978 | Matthews | 15/320 |
| 4,112,535 | 9/1978 | Wild et al. | 15/98 |
| 4,433,511 | 2/1984 | Swain | 51/424 |
| 4,593,497 | 6/1986 | O'Dell et al. | 51/424 |
| 4,895,179 | 1/1990 | Hart | 134/172 |
| 4,934,475 | 6/1990 | Urakami | 180/164 |
| 5,078,161 | 1/1992 | Raghavan et al. | 134/16 |
| 5,181,348 | 1/1993 | Roemmele et al. | 51/410 |
| 5,291,697 | 3/1994 | Nelson | 51/429 |

*Primary Examiner*—Zeinab El-Arini
*Attorney, Agent, or Firm*—Sand & Sebolt

[57] ABSTRACT

A method of cleaning surfaces so as to remove dirt, buildup, paint, asbestos, coating materials, or any other buildup or layer from the surface using a high fluid pressure cleaning for removing coatings and buildup from hard, often porous, and generally unpermeable surfaces such as brick, concrete, limestone, masonry, stone, asphalt, etc. Specifically, the method of surface cleaning involves high pressure water dispensation, or non-caustic chemical and then high pressure water dispensation via a number of different sized, shaped, and usage housings that include at least one rotating jet for applying the high pressure cleaning water that thereafter vacuumed out of the housing after cleaning by a high suction vacuum where the housing includes one or more rows of annular or peripheral sealing means such as brushes, rubber seals, rubber wipers, or other similar flexible yet sealing instruments. The housing is moved along the surface to be cleaned which in the case of a building is vertically up and down a track, while also being moved horizontally from a cleaned path to a non-cleaned but to be cleaned path.

11 Claims, 33 Drawing Sheets

SEE FIG-4B
SEE FIG-4A
1
2
3
4
6
8
10
11
11H
12
13
15
23
24
25
26
29
30
31
40
41
42
43
45
47
48
49
52
58
60
61
62
65
66
67
68
70
71
72
74
75
77
86
87
88

METHOD OF HIGH PRESSURE CLEANING

CROSS REFERENCE TO RELATED APPLICATIONS

This patent application is a continuation in part of Ser. No. 08/893,729, entitled "High Pressure Cleaning and Removal System", filed on Jul. 11, 1997, now U.S. Pat. No. 5,991, 968, and from which priority is claimed.

BACKGROUND OF THE INVENTION

1. Technical Field

The invention relates to a method of cleaning surfaces so as to remove dirt, buildup, paint, asbestos, coating materials, or any other buildup or layer from the surface. More particularly, the invention relates to method of high fluid pressure cleaning for removing coatings and buildup from hard, often porous, and generally unpermeable surfaces such as brick, concrete, limestone, masonry, stone, asphalt, etc. Specifically, the invention is a method of surface cleaning using high pressure water or non-caustic chemicals and then high pressure water applied via a number of different sized, shaped, and usage housings that include at least one rotating jet for applying the high pressure cleaning water that thereafter vacuumed out of the housing after cleaning by a high suction vacuum where the housing includes one or more rows of annular or peripheral sealing means such as brushes, rubber seals, rubber wipers, or other similar flexible yet sealing instruments.

2. Background Information

For decades, various method and devices have been used to attempt to clean generally planar surfaces such as walls, floors, driveways, sidewalks, etc. which are generally flat and hard, yet often porous. This cleaning has been necessary to remove applied layers or coatings such as paints, etc., as well as unintentional accumulated deposits and buildup. For instance, many structures or buildings are built of concrete, brick, stone, block, limestone, masonry or other similar materials which may also be painted and otherwise coated over time. In addition, dirt, pollution, smog and other airborne particles often also deposit thereon. At some point in time, these coatings and deposits may need removed.

This removal can be further complicated by additional factors such as asbestos coatings which can only be removed using methods certified by the Federal government due to the hazardous effects of airborne asbestos particles. For this reason, the removed material must be completely contained so as to avoid any airborne implantation of the particles.

In the past, sandblasting or other treating of surfaces by impingement of the surface with particulate abrasive material has often been used to remove the above-referenced materials from the above-referenced hard surfaces. However, sandblasting has various disadvantages including the degradation or destruction caused by the abrasive sand or other particulate material to the surface being cleaned. In addition, sand is generally messy and hard to contain. Furthermore, the use of sand or other abrasive materials requires a large supply of such material available at the job site, and therefore requires material transportation cost. A further disadvantage of the use of sand is the difficulty in removing the contaminants from the sand. Finally, often the structure being cleaned must be completely contained such as in a sealed tent or a wrap to assure containment of the sand or other abrasive material, and in the case of hazardous material removal, to assure containment of the loosened and removed hazardous material so that proper disposal is assured.

In response, several attempts have been made at alternative surface cleaning devices. For instance, devices using cleaning liquids directed against the surface have also been suggested, such as that in U.S. Pat. No. 4,895,179. The cleaning apparatus in '179 patent is for cleaning a generally planar and horizontal surface. The device includes a jet of cleaning liquid directed against the surface. Other liquid cleaning devices have also been invented.

The present technology of liquid cleaning devices and methods has several disadvantages. First, the pressure and acceleration of the liquid is often merely sufficient to rinse away loose dirt and other buildup while not being sufficient to remove applied coatings. Second, many of the current cleaning devices and methods do not provide a sufficient surface cleaning area to make use of the device feasible on buildings, driveways, etc., which include very large surface areas. Third, the prior art fluid cleaning devices and methods have proved inefficient or completely ineffective at containing the cleaning fluid as well as the debris created therefrom, whereby such containment is critical for a number of reasons including overall cleanliness of the project and overall containment of any hazardous materials found in the removed coatings and buildup. Furthermore, all of the current fluid cleaning devices and methods do not provide for any ability to clean nonplanar and often nonhorizontal surfaces. Similarly, corners and edges and other tight spots are also not addressed by the current fluid cleaning devices and methods.

Clearly, an improvement is needed in the cleaning device and method area to overcome some or all of the disadvantages and problems addressed above. This is particularly important with the aging of buildings and other structures today. These structures include schools, government buildings, churches, and other buildings, many of which were built during or before World War II, some of which were built during or before World War I, and others built in the 1700 and 1800's. In addition, many aging buildings and structures exist in Europe, the Middle East and the Far East that date back hundreds and thousands of years. All of the buildings are in dire need of cleaning, many are owned by entities with limited budgets, many are restricted in the methods and devices that may be used to clean, and in many instances the government has placed restrictions on the cleaning process and/or its cleanup and disposal steps.

In America, this aging of buildings and the need to clean them is more prevalent in the area of schools than in any other area. Many schools, particularly those in America's cities, have been neglected for years and in many cases decades. In addition, many were painted decades ago using lead paint and/or were insulated or built using asbestos products. As a result, cleaning of the buildup and debris is becoming critical and removal of the lead paint and asbestos necessary. However, the current alternatives are so expensive that most school districts cannot afford such necessary cleaning processes.

SUMMARY OF THE INVENTION

It is an objective of the present invention to provide an improved cleaning method and device.

It is further an objective of the present invention to provide an improved surface cleaning method and device with a or using a material removal system coupled thereto.

It is further an objective of the present invention to provide an improved surface cleaning method and device that uses fluids such as water or retreating with non-caustic chemicals followed by water to perform the cleaning.

It is further an objective of the present invention to provide an improved surface cleaning method and device using a high pressure fluid such as high pressure water.

It is further an objective of the invention to provide a surface cleaning and debris removal system and method using high pressure water in which coatings and other buildup are removed from the surface being cleaned.

It is further an objective of the invention to provide a surface cleaning method and device capable of cleaning hazardous or otherwise environmentally unfriendly material from a surface.

It is further an objective of the present invention to provide a surface cleaning method and device using high pressure water where a removal system is coupled thereto and assures substantially if not all of the water and debris is maintained within the system.

It is further an objective of the invention to provide a surface cleaning method and device using high pressure water in which the housing is movable along the surface while also supplying a vacuum that maintains all of the fluid and debris within the housing.

It is further an objective of the invention to provide a surface cleaning method and device using high pressure water in which one or more peripheral sealing elements are positioned around the outermost edge of the walls defining the housing so as to provide improved vacuum without inhibiting movement of the housing.

It is further an objective of the invention to provide various different housing designs and configurations for use on horizontal surfaces, vertical surfaces, within rails or other vertical supports, in corners, along edges, and in other tight areas.

It is further an objective of the present invention to provide a quick-connect connector for use in connecting the vacuum hose to the housing such that connection and disconnection may be rapidly performed.

It is further an objective of the present invention to provide such a quick-connect that is rotatable during use.

It is further an objective of the present invention to provide a surface cleaning method and device using high pressure water in which the water is ejected against the surface via a jet.

It is further an objective of the present invention to provide the above-described surface cleaning device in which the jet is rotatable within the housing.

It is further an objective of the present invention to provide the above-referenced surface cleaning device in which the rotatable jet includes a brush or similar mechanism.

It is further an objective of the present invention to provide an environmentally safe and efficient method of cleaning interior and exterior walls, floors, ceilings, driveways, sidewalks and any other surfaces of a hard, yet porous nature such as concrete, brick, masonry, block, limestone, etc.

It is further an objective of the present invention to provide an environmentally safe and efficient method of removing paint such as lead based paint, asbestos, water repelling or resisting coatings, other coatings, mold, mildew, dirt, debris, rotten organic matter such as leaves, and other buildups, layers or coatings.

These objectives and advantages are obtained by the improved high pressure cleaning and removal method, device and system of the present invention, the general nature of which may be stated as including a method of cleaning aged or dirty buildings and structures made of brick, masonry, stone, block, limestone or other similar hard, yet porous, building materials so as to remove applied or built-up coatings and paints, mildew, mold, dirt, organic matter, stains, mineral deposits, debris and any other matter, the method including the steps of dispensing high pressure water from a fluid dispensing head within a housing for providing a high pressure fluid flow against the surface to be cleaned, and suctioning the water and any coatings, debris, and other matter that is removed from the surface out of the housing.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

A first embodiment of a surface cleaning and material removal system of the present invention is generally shown in FIGS. 1–4 and indicated as 1. The surface cleaning and material removal system 1 as shown in this embodiment as well as the others disclosed below is used for cleaning surfaces so as to dislodge and remove any coatings or other materials that have been applied to or built up on that surface but are now desired to be removed. Specifically, the surface cleaning and material removal system 1 is used for removing coatings and buildup from hard, often porous, and generally unpermeable surfaces such as but not limited to concrete, masonry, limestone, brick, block, stone, asphalt, etc. It is often desirable to clean these and other surfaces of dirt, paint, asbestos, water proofing, tar, coating materials, or other buildup or layered coatings either intentionally deposited or incidentally built-up on the surface to be cleaned but no longer needed or desired thereon.

Figure 1:
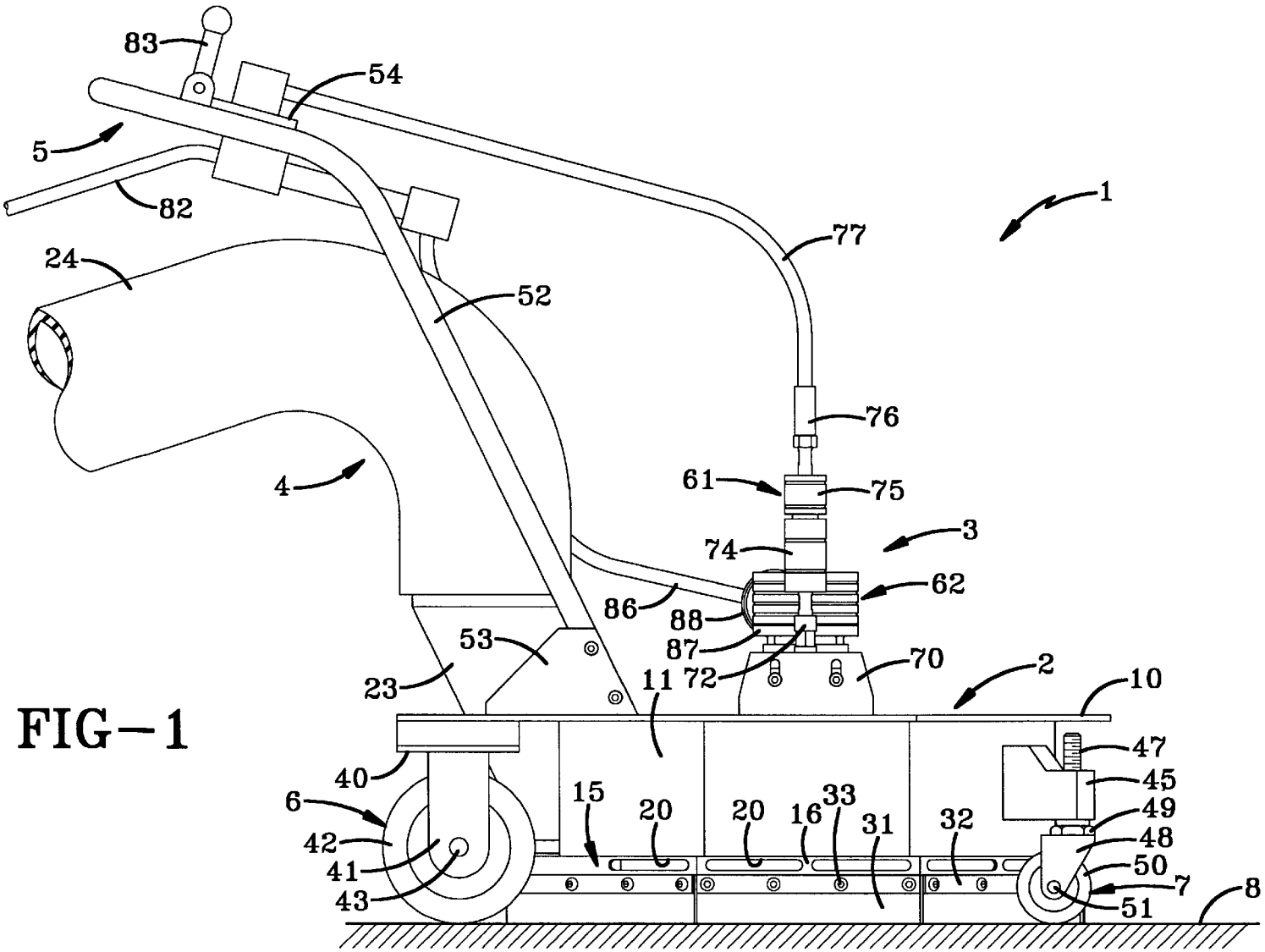
FIG. 1 is a side elevational view of a high pressure cleaning and removal system.

In the first embodiment as is shown in FIGS. 1–4, the surface cleaning and material removal system 1 includes a housing 2, a high-pressure-fluid cleaning mechanism 3, and a vacuum mechanism 4. In addition, in large-sized versions of the system (the version in FIG. 1 is of a large size), the surface cleaning and material removal system also includes a handle mechanism 5 and wheels, namely one or both fixed wheels 6 and pivotable wheels 7. The wheels ride on a surface 8 to be cleaned.

Figure 2:
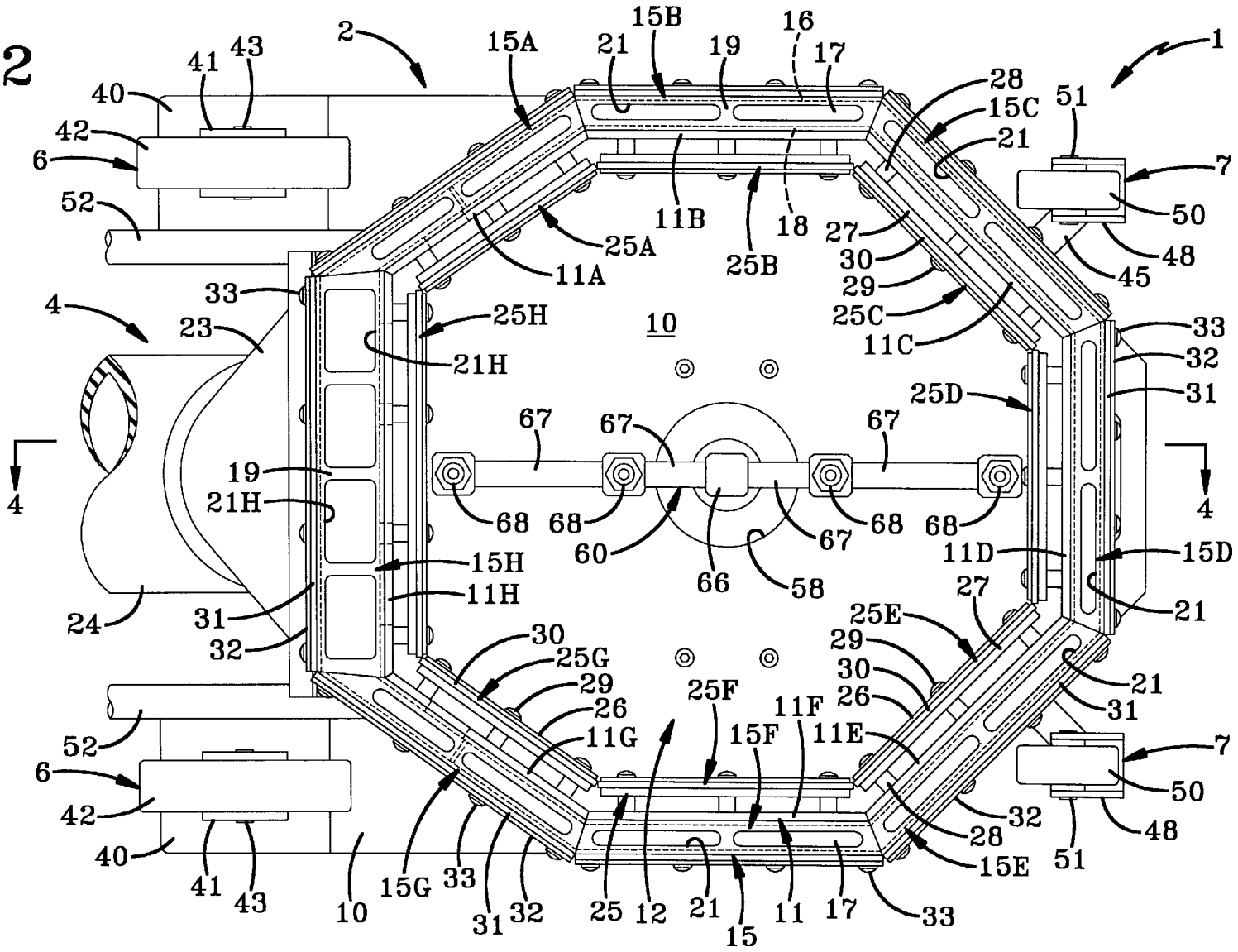
FIG. 2 is a bottom plan view of the high pressure cleaning and removal system of FIG. 1.
Figure 3:
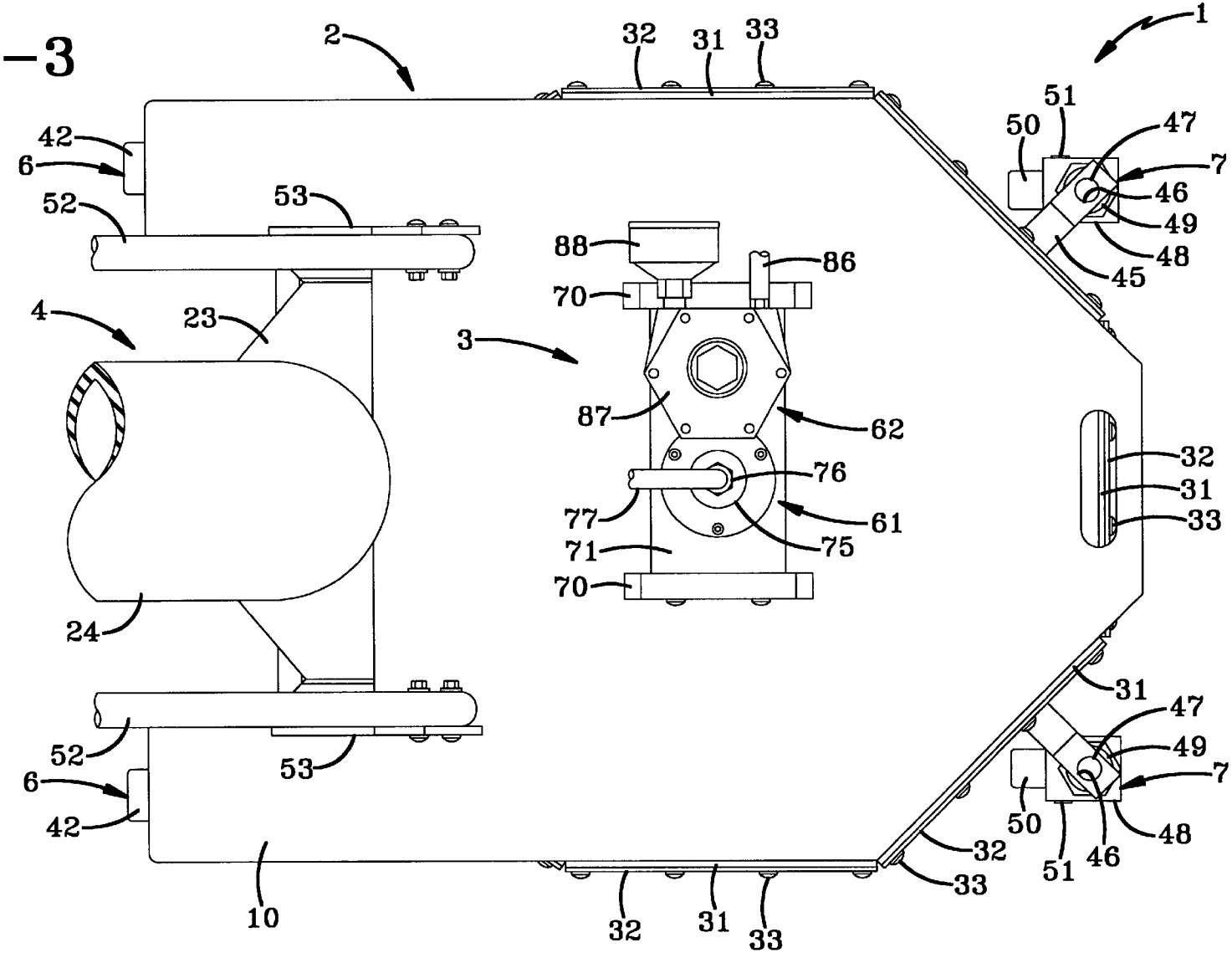
FIG. 3 is a top plan view of the high pressure cleaning and removal system of FIGS. 1 and 2.
Figure 4:
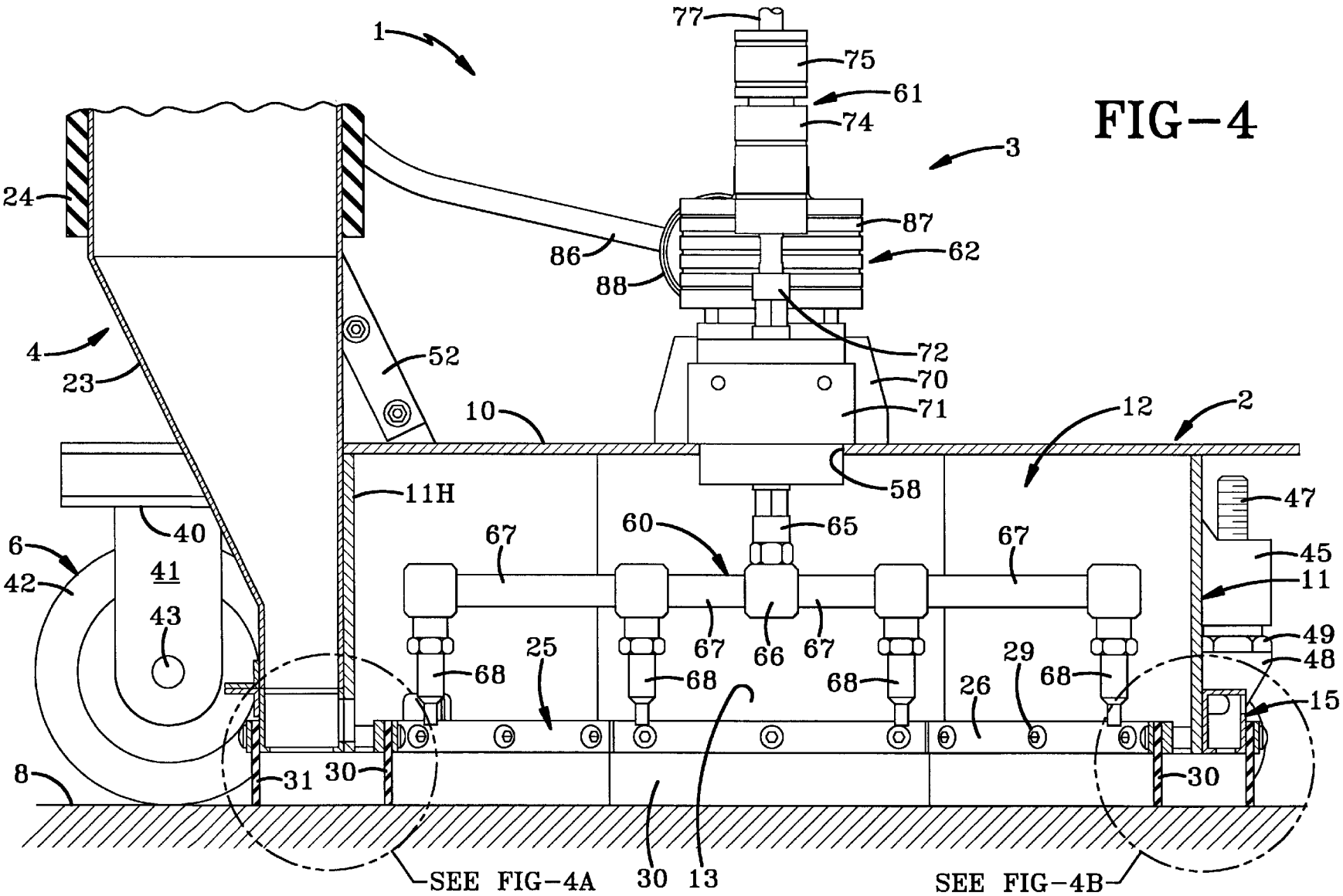
FIG. 4 is a sectional view of the high pressure cleaning and removal system of FIGS. 1–3 taken along line 4—4 in FIG. 2.

The first embodiment of the housing 2 as best shown in full in FIGS. 1–3 and in part in FIG. 4 includes a plate 10 which is in effect a deck, base or platform from which at least one wall 11 obliquely extends. The plate 10 and wall 11 define a cavity 12 with an open area 13 facing the surface 8 to be cleaned. In FIGS. 1–4, the plate 11 is of an octagonal shape and has eight wall parts 11A, 11B, 11C, 11D, 11E, 11F, 11G, and 11H (best shown in FIG. 2) extending outward from one side of the plate to in a perpendicular manner to the plate 10. The plate 10 however could be of any of a number of other shapes including but not limited to round, triangular, square, rectangular, pentagonal, hexagonal, heptagonal, or decagonal and correspondingly the wall 11 would have an equivalent number of wall parts, that is one, three, four, four, five, six, seven, or ten, respectively. Also, the wall parts defining the wall(s) may be either planar such as is best shown in FIG. 2 or non-planar such as where the plate 10 is round and thus the wall 11 is curved in an annular manner.

Figure 4A:
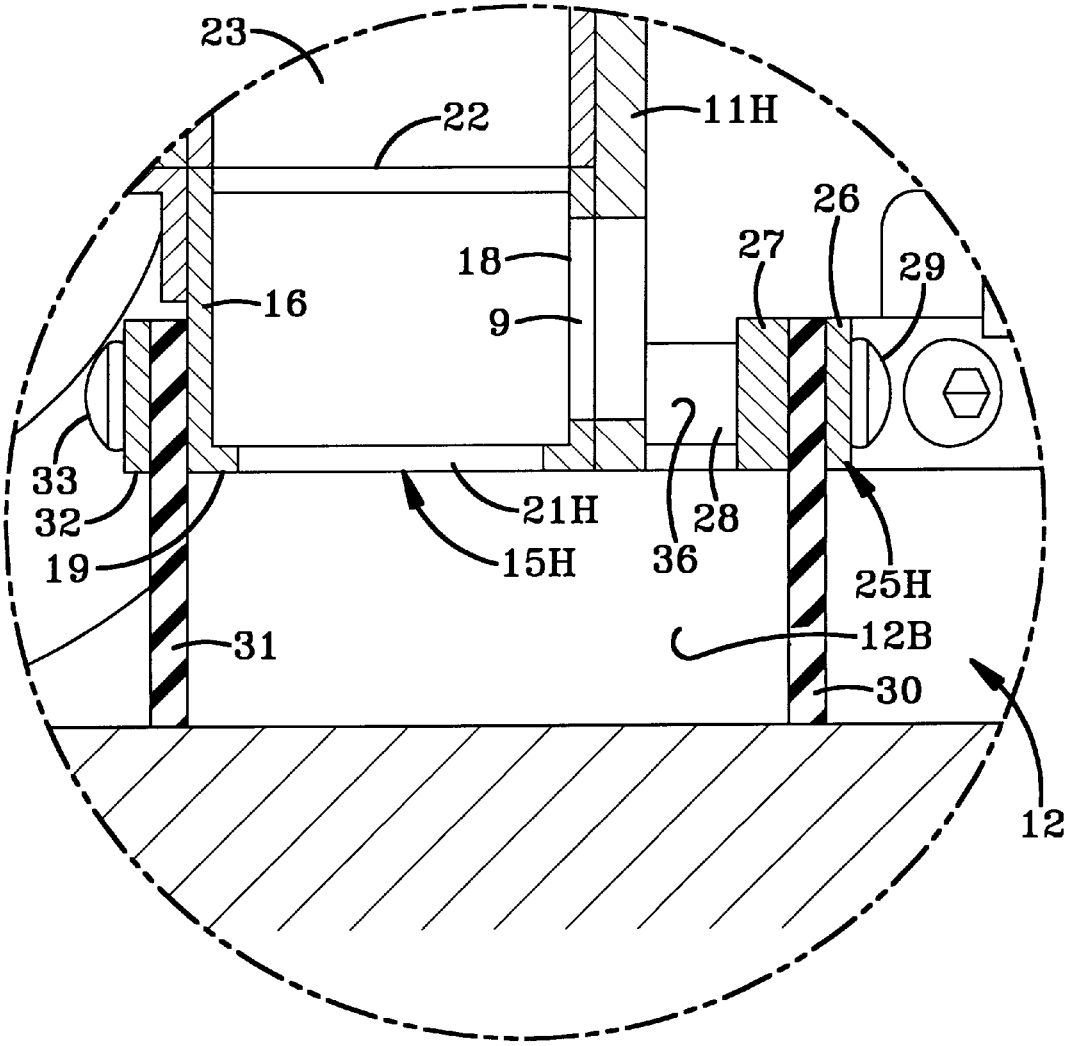
Figure 4B:
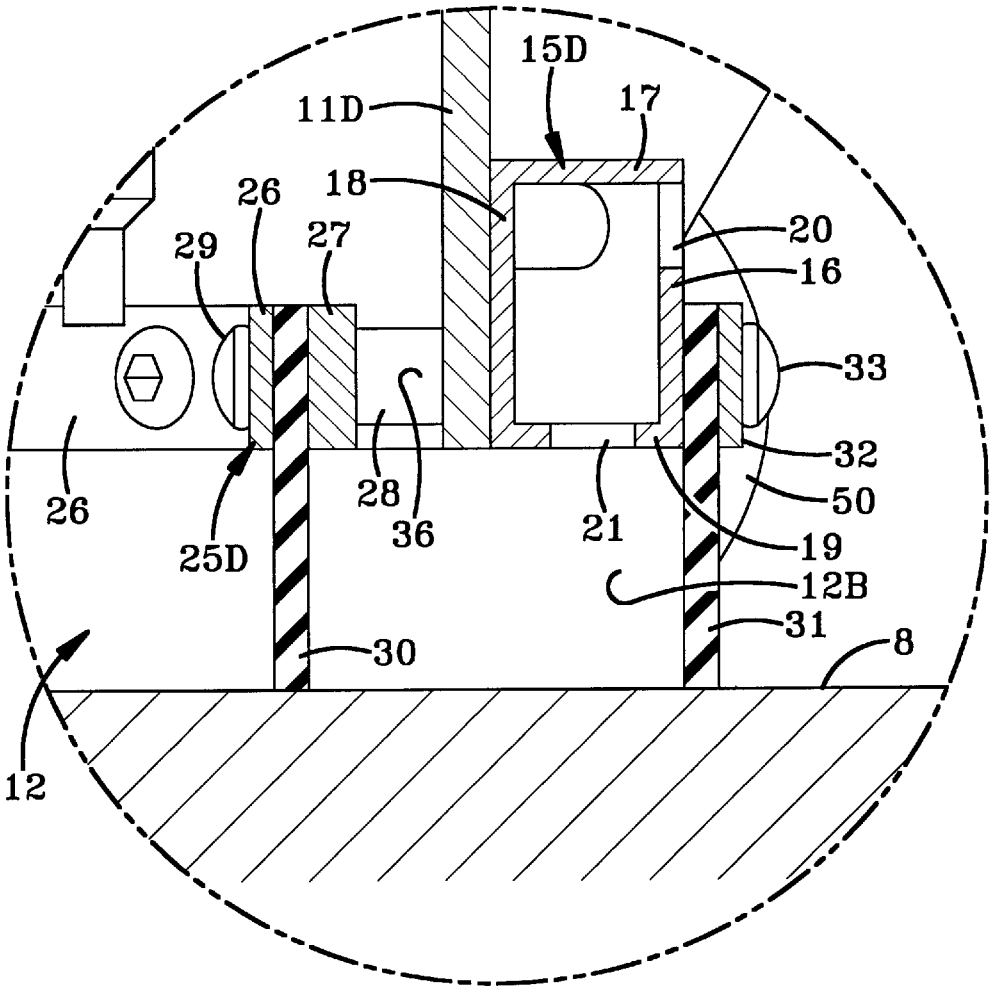

A hollow member 15 is attached to the outer surface of the wall 11 along the outermost (furthest away from the plate 10) portion of the wall from the plate. The hollow member 15 extends around the entire perimeter of the wall 11 thereby defining one endless fluid chamber around the perimeter of the housing 2. The hollow member 15 in the embodiment shown in FIGS. 1–4 is a plurality of pieces 15A, 15B, 15C, 15D, 15E, 15F, 15G, and 15H attached together in a similar manner to the wall parts 11A–11H. (As previously discussed, the member 15 could be one piece or any number of pieces corresponding to one or any number of walls.) The hollow member 15 in the embodiment shown in FIGS. 1–4 and 4A–4B is designed such that the cross section of the member is of a rectangular or square sectional area defined by a front flat surface 16, a top flat surface 17, a back flat surface 18, and a bottom flat surface 19 as is best shown in FIGS. 4, 4A, and 4B. As also shown in FIGS. 4, 4A, and 4B, the hollow member 15 also includes a first plurality of elongated slots 20 (breather slots) in the front flat surface 16 and a second plurality of elongated slots 21 (fluid flow slots) in the bottom flat surface 19.

In the preferred embodiment as shown, the hollow member 15A–15G is of an upright rectangular sectional shape along each of the wall parts 11A–11G and includes slots 20 and 21 substantially equally dispersed therealong, while the hollow member 15H along wall part 11H (the backmost wall area) is enlarged with respect to the other portions. Specifically, the hollow member 15H along wall part 11H is of a substantially larger width orientation as is shown in FIG. 4 such that the sectional shape is a lying-down rectangle. In addition, the hollow member 15H along wall part 11H does not include a standard slot or slots 20 in the outer surface, but instead includes an inner slot 9 for vacuuming purposes. (Hollow members adjacent to hollow member 15H may also have a reduced number or complete elimination of the slots 20 as needed to properly assure a vacuum). Furthermore, the hollow member 15H along wall part 11H has enlarged slot(s) 21 in comparison to those in the other wall parts 11A–11G and thus identified as 21H.

The hollow member 15H along the wall part 11H has an open top 22 rather than a top flat surface 17. The open top 22 is connected to a funnel 23 in the vacuum mechanism 4. The vacuum mechanism as shown in FIGS. 1–4 also includes a hose 24 which connects to a vacuum supply (not shown).

Also connected to the housing 2, on the opposite or inner surface of wall 11 as the hollow member 15, is a support plate 25 that extends around the entire inner perimeter of the wall 11 about its bottommost portion. In the embodiment shown in FIGS. 1–4, the support plate is actually a plurality of (in this case eight) support plate portions 25A, 25B, 25C, 25D, 25E, 25F, 25G, and 25H corresponding to each of the eight wall parts 11A–11H. Each of the support plate portions 25A–25H includes a first plate 26, a second plate 27, and a plurality of pegs 28 for spacing the plates 26 and 27 apart from the wall 11 of the housing 2 as best shown in FIG. 2. A screw, rivet or other fastener 29 extends through plates 26 and 27, and one of the pegs 28 to secure the support plate 25 to the wall 11 along the bottommost, inner edge of the wall.

An inner sealing member 30 is supported between the plates 26 and 27 by the fasteners 29. Sealing member 30 extends outward from the support plates 25 in an opposite direction as the wall 11 thereby defining an extension 12A to cavity 12. Sealing member 30 may be a flexible rubber plate, a bristle brush, a seal of any type, or any other member capable of providing a flexible body that follows the contours of surface 8 while sufficiently providing sealing to support the vacuum functions of the cavity during cleaning as described below in more detail. In the first embodiment, as shown in FIGS. 1–4, sealing member 30 is actually 8 sealing portions aligned end to end in a touching relationship to form an octagon.

Housing 2 also includes a second or outer sealing member 31. The outer sealing member 31 is attached to the outer surface of the hollow member 15 by an elongated plate 32 that sandwiches the sealing member against the front or outer flat surface 16 of the hollow member 15. A plurality of screws, rivets or other fasteners 33 affix the outer sealing member 31 to the hollow member 15. The outer sealing member 31 is of a substantially identical construction to the inner sealing member 30 in that it may be a flexible rubber plate, a bristle brush, a seal of any type, or any other member capable of providing a flexible body that follows the contours of surface 8 while sufficiently providing sealing to support the vacuum functions of the cavity during cleaning as described below in more detail. Similar to sealing member 30, sealing member 31 in the first embodiment is actually eight sealing portions aligned end to end in a touching relationship to form an octagon larger than and surrounding the octagon of the inner sealing members 30. In addition, the inner and outer sealing members may be of differing types, that is one may be a flexible rubber plate while the other is a bristle brush.

As a result of the inner and outer sealing members 30 and 31, an annular chamber 12B is defined which in effect expands the area of the extension 12A of the cavity 12. A tortuous path 35 connects the extension area 12A with the cavity 12 with the annular chamber 12B with the hollow member 15. The path 35 extends through a gap 36 as defined between the pegs 28 and through the slots 21 such that fluid and debris in cavity 12 and extension 12A can be vacuumed or suctioned into vacuum hose 24, and any leakage that leaks under inner sealing member 30 into annular chamber 12B is also vacuumed or suctioned into vacuum hose 24. The fluid and debris passes through the gap 36 into the annular chamber 12B where it is suctioned through the slots 21 into the hollow member 15. All of the fluid and debris in the hollow member 15 is suctioned around to the larger section of the hollow member along the wall part 11H where the fluid and debris passes through open top 22 and funnel 23 toward a collection mechanism (not shown) in the vacuum mechanism 4.

Also attached to the housing 2 of the embodiment shown in FIGS. 1–4 are the wheels 6 and 7. The fixed wheels 6, as best shown in FIGS. 1–2 and 4, are each mounted to the housing 2 on a rigid plate 40 from which a pair of axle supports 41 extend. Each wheel 42 includes an axle 43 rotatably affixed between and within the respective axle supports 41. As to the pivotable wheels 7, also best shown in FIGS. 1–2 and 4, each pivotable wheel is mounted to the housing 2 on a bracket 45 with a hole 46 therein. A threaded pin 47 extends through and out of the hole where the pin terminates in a fork 48 attached via a bearing or other pivot connection 49. A wheel 50 with an axis 51 is supported between the fork 48 and is pivotable about the bearing 49. In the embodiment shown, a pair of fixed wheels 6 are used on the rear of the housing while a pair of pivotable wheels 7 are used on the front of the housing.

Further attached to the embodiment shown in FIGS. 1–4 is a handle mechanism 5. Handle mechanism 5 includes a handle bar 52 extending outward from a handle bracket 53 on the housing. Approximate the outer end of the handle bar 52 is a control plate 54 for supporting switches, levers, and other controls as needed to operate the high-pressure-fluid cleaning and removal system 1.

The first embodiment of the housing 2 further includes a hole 58 in the plate 10. As shown in FIG. 4, the high-pressure-fluid cleaning mechanism 3 partially extends through this hole 58. This cleaning mechanism 3 includes a washing head 60, high pressure water system 61, and a rotation providing mechanism 62 all of which interact to provide high or ultra high pressure fluid such as water for cleaning the surface 8 to be cleaned.

As shown in FIG. 4, the first embodiment of washing head 60 includes a rotatable main feed 65, a "T" or other branching fitting 66, one or more branch feeds 67, and a plurality of jets 68 on each branch feed.

As also shown in FIG. 4, the first embodiment of the high pressure water system 61 includes a mounting bracket 70, a gear box 71, a gear box drive shaft 72, a swivel within a swivel housing 74, a swivel nut 75, a hose fitting 76, an ultra high pressure water hose 77, and an ultra high pressure water supply (remotely located and not shown). Mounting bracket 70 is mounted on the top surface of plate 10 over hole 58.

Gear box 71 is mounted within mounting bracket 70. Gear box drive shaft 72 extends through the gear box 71 and is rotatably driven by the gear box 71. Attached to one end of the drive shaft 72 is the washing head 60 and attached to the other end of the drive shaft 72 is the swivel housing 74 and the swivel nut 75. The swivel housing 74 and swivel nut 75 remain stationary while the drive shaft 72 rotates as the swivel nut provides a connection for the hose fitting 76 on the end of the water hose 77 to the drive shaft 72 which is hollow with a fluid passage therein to the washing head 60. The swivel housing 74 and swivel nut 75 allow the drive shaft to rotate from within while remaining stationary, and provide a fluid connection of the stationary water hose 77 to the rotatable drive shaft 72.

As further shown in FIG. 4, the first embodiment of the rotation providing mechanism 62 includes a main air supply hose 82, a trigger or actuation/control lever 83, a motor air supply hose 86, an air motor 87, and a muffler 88. The air motor 87 is attached to the gear box 71 for providing air for driving the drive shaft 72. The air supply hose 82 connects the lever 83 to a remote pressurized air supply (not shown), where the lever 83 in this embodiment is attached to the handle 5. Lever 83 and/or any other controls on the handle 5, control air and/or water flow through air hose 86 and water hose 77. When the lever 83 is actuated, the air is allowed to pass from hose 82 through the passage to hose 86 which is connected to air motor 87. The air then drives the drive shaft 72.

In operation, system 1 is positioned such that open area 13 is over the surface 8 to be cleaned. Lever 83 is moved thereby allowing pressurized air from hose 82 into hose 86. The pressurized air drives the air motor 87 which in turn rotates the drive shaft 72 of the water system 61 causing the washing head 60 to rotate. Simultaneously with the movement of the lever 83, ultra high pressure water from a remote water supply is allowed to pass into water hose 77 whereby the water travels to the washing head 60 via the hollow interiors of the swivel housing 74, swivel nut 75, and the drive shaft 72. The ultra high pressure water is dispersed from the washing head 60 via the jets 68. The water pressure exiting the jets is maintained at between a few thousand psi and 100,000 psi depending upon the surface material and the types of coating and debris thereon, although for many applications it has been found that 30,000–40,000 psi is optimal.

The coatings and debris are in effect power washed from the surface by the ultra high pressure water. The coatings and debris (material), and the water are substantially maintained within the cavity 12 and extension 12A by the inner sealing member 30. However, to assure complete containment, sealing member 31 further assures that any material that escapes from the cavity 12 and extension 12A is held within the annular chamber 12B as defined between the annular sealing members 30 and 31. A vacuum is supplied to the cavity 12, extension 12A, and annular chamber 12B via open top 22 and funnel 23 whereby the material is vacuumed from cavity 12 and extension 12A to a remote vacuum. The material follows the tortuous path 35 from cavity 12 and extension 12A either (A) to the back wall 11H of cavity 12 and through inner slot 9 to hollow member 15H and funnel 23 whereby the material is suctioned out to a remote collection container via vacuum hose 24, or (B) over support plate 25 and through the space or gap 36 between pegs 28 to the annular chamber 12B and hollow member 15 (via slots 20) where the material follows the annular chamber and/or hollow member around the housing to the larger hollow member 15H, where the material continues to be suctioned out to a remote collection container via funnel 23 and vacuum hose 24.

During operation of the vacuum, the suctioning or vacuum force may be of any volume capable of supplying sufficient vacuum to assure no leakage under the sealing members 30 and 31. In one operational environment it has been found that between 1,000 and 10,000 cfm was adequate, with between 4,000 and 6,000 cfm being optimal. The slots 21 are supplied to allow a certain amount of ambient air into the system to replace air, water and debris suctioned out and to assist the vacuum process by providing an aspirating behavior as is well known in aspirators for inflating devices such as air slides and rafts.

The wheels 6 and 7 allow the housing 2 to be moved around to remove coatings and debris over a large area. The handle 5 allows a user to push the housing 2. Specifically, the unit is pushed or pulled in a systematic manner such that a large surface area is cleaned, in effect a row or pass at a time, until all of the adjacently defined rows cover the entire large surface area. After completion, the material collected in the remote location such as a tank or truck is filtered such that the water is removed from the coatings, debris, dirt, hazardous materials, etc. whereby these materials are then properly disposed. The net result is that the housing 2 with its cavity 12 and sealing members 30 and 31 therearound with a vacuum supplied thereto alleviate the need for cleanup and the need for prior preparation of the area such as tenting as is well known in the asbestos cleanup area. All of the removed material is collected by the system for disposal; and this all includes even the ultra high pressure water used to remove the coatings, buildup and debris.

Figure 5:
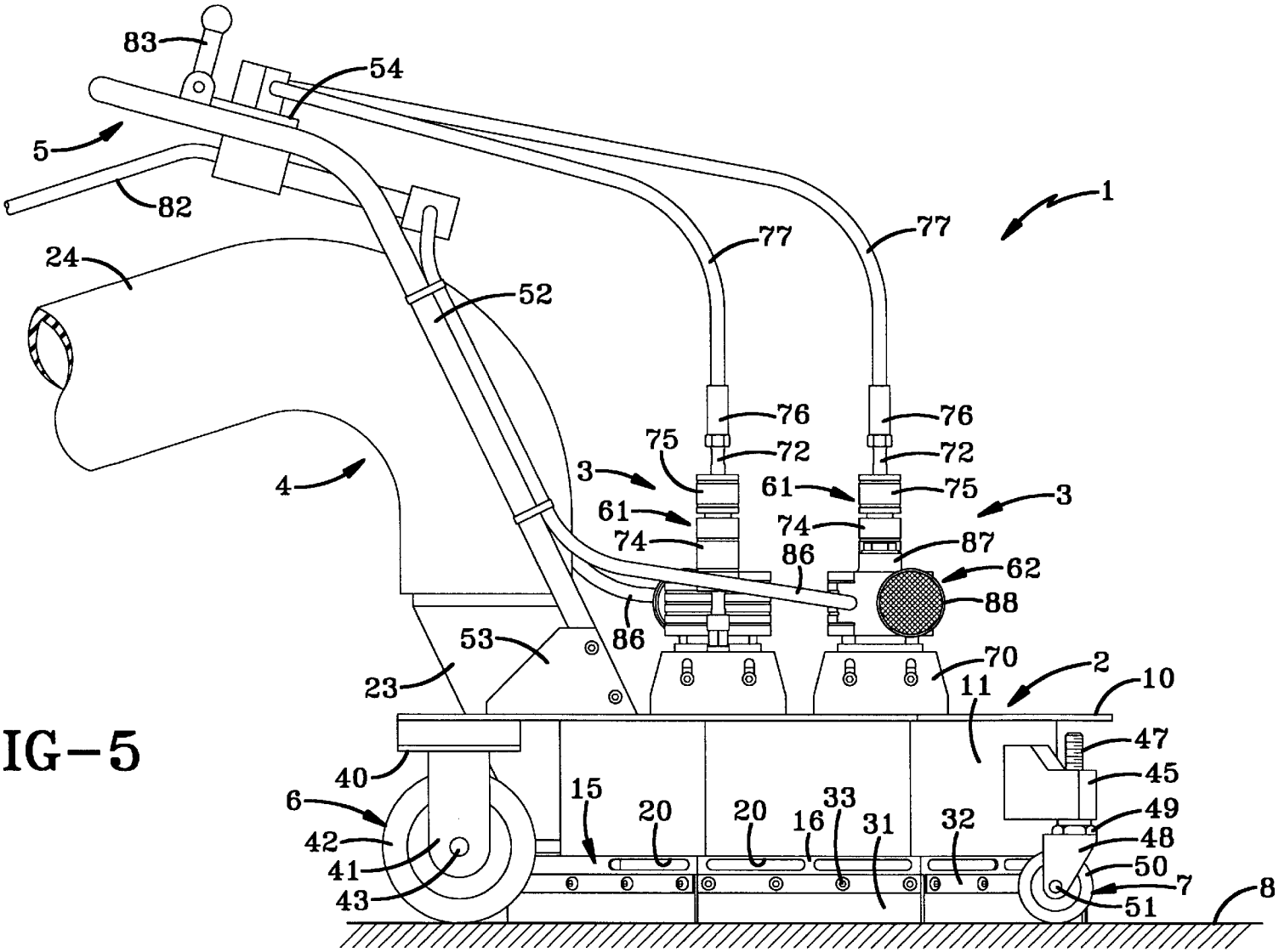
FIG. 5 is a side elevational view of the high pressure cleaning and removal system with an additional or second high pressure fluid mechanism.
Figure 6:
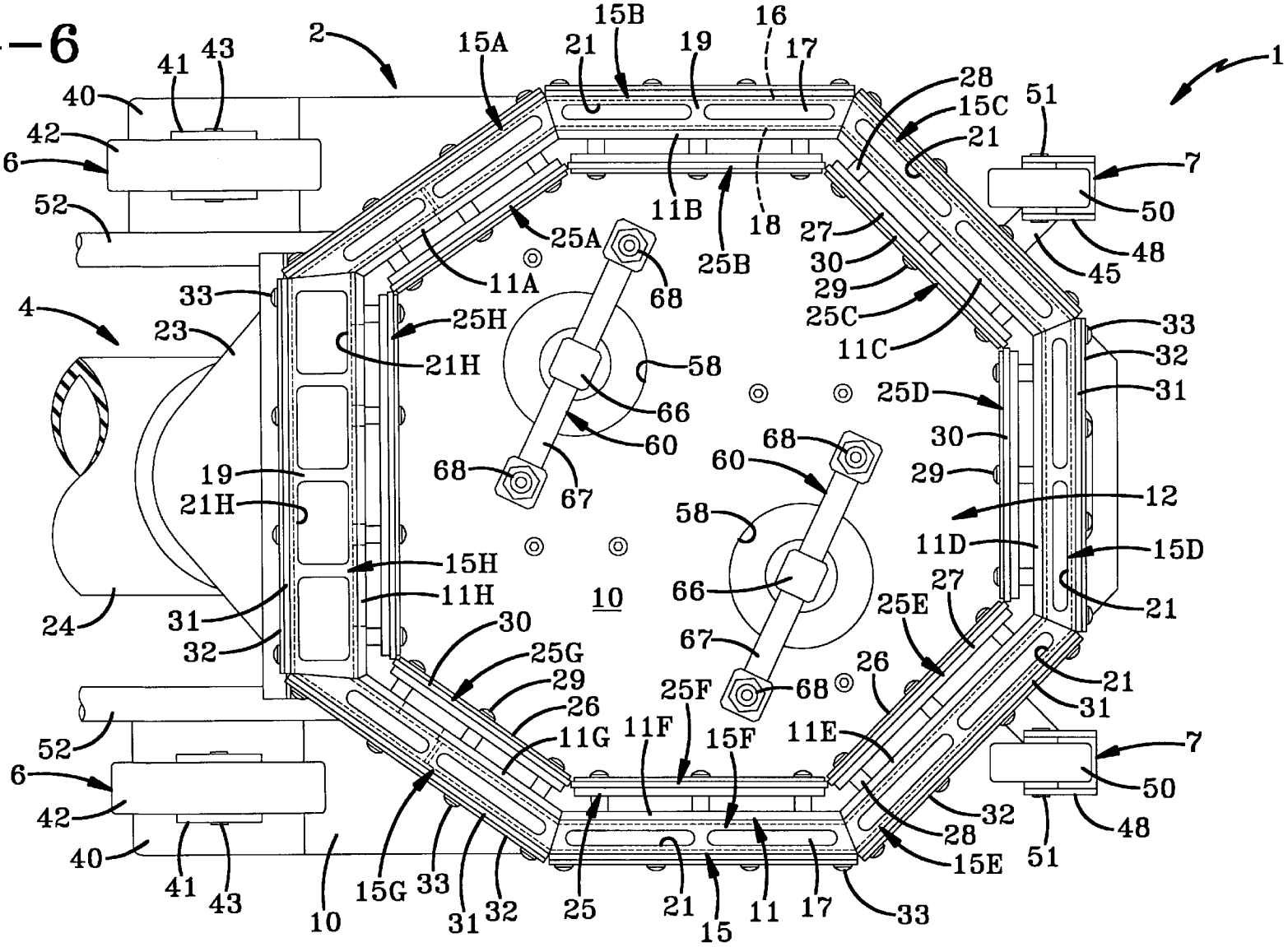
FIG. 6 is a bottom plan view of the high pressure cleaning and removal system of FIG. 5.
Figure 7:
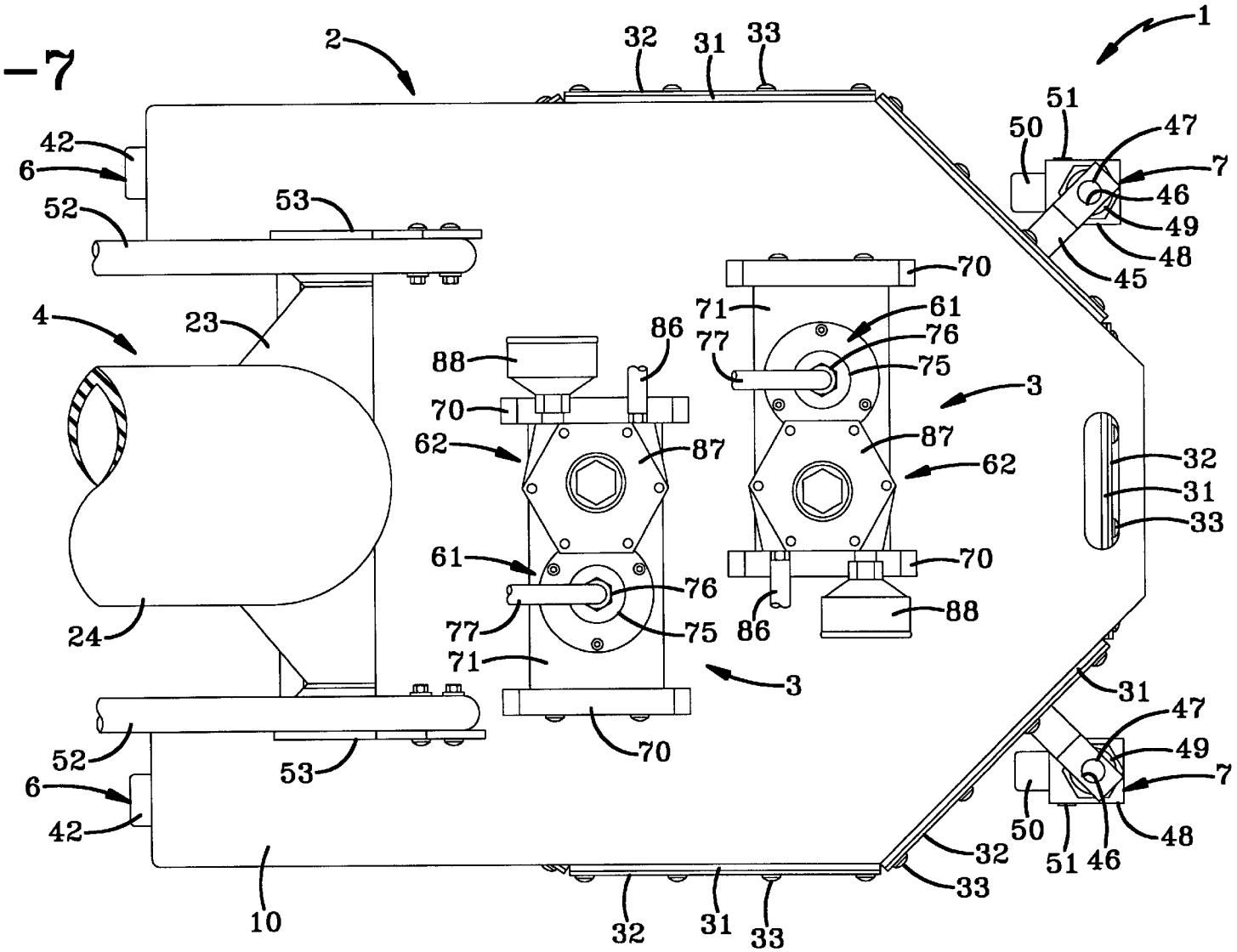
FIG. 7 is a top plan view of the high pressure cleaning and removal system of FIGS. 5 and 6.

A modified version of system 1 is shown in FIGS. 5–7 in which a pair of cleaning mechanisms 3 rather than one are installed within the housing 2. Specifically, two holes 58 are found in the housing, and two washing heads 60, two high pressure water systems 61, and two rotation providing mechanisms 62 clean the surface 8. Otherwise, the parts of this second embodiment are identical to those of the first embodiment.

Figure 8:
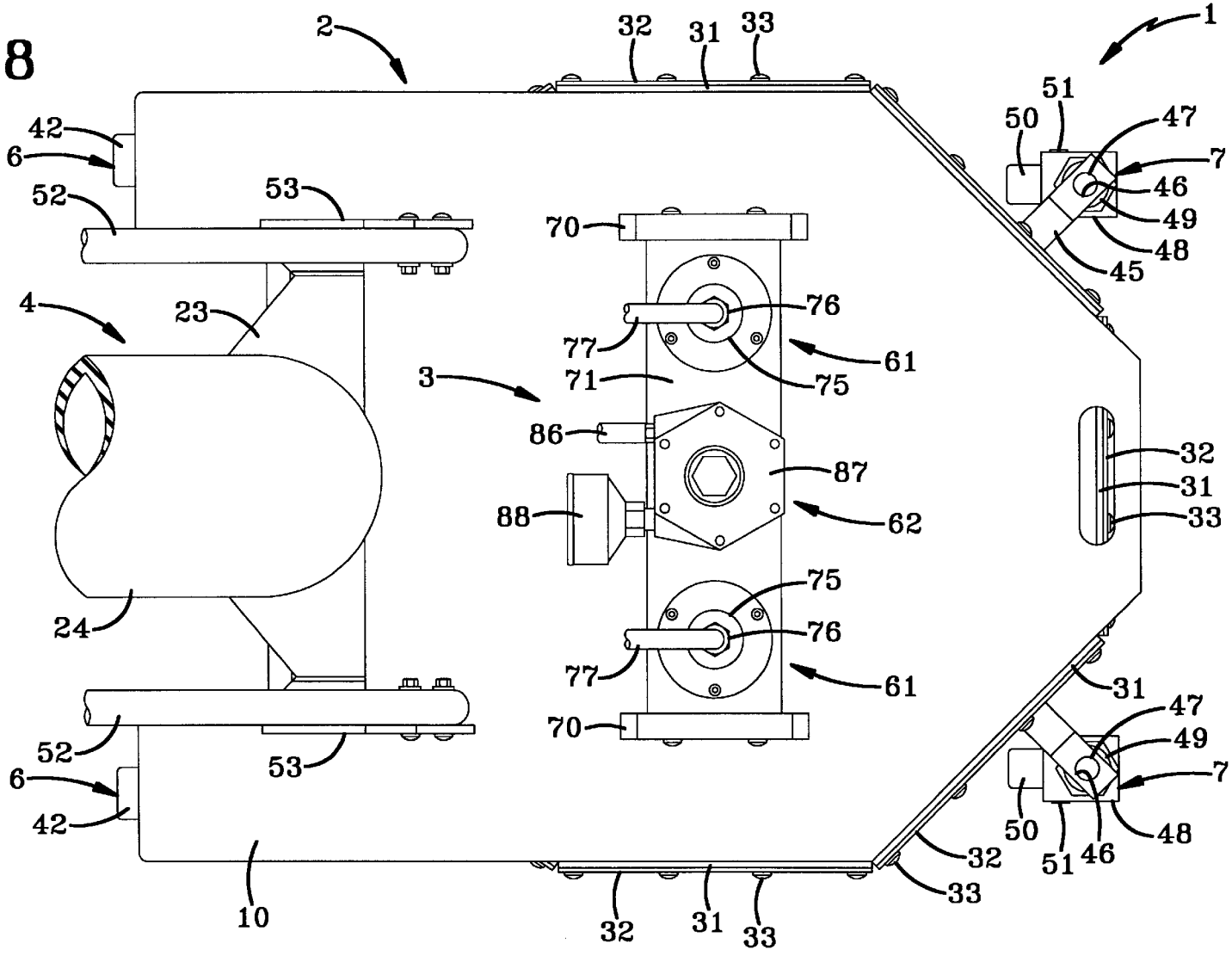
FIG. 8 is a top plan view of the high pressure cleaning and removal system with two high pressure water systems within the high pressure fluid mechanism.

Another modified version of system 1 is shown in FIG. 8 in which a pair of washing heads 60 and a pair of high pressure water systems 61 are coupled to one rotation providing mechanism 62. Otherwise, the parts of this third embodiment are identical to those of the first and second embodiments.

Figure 9:
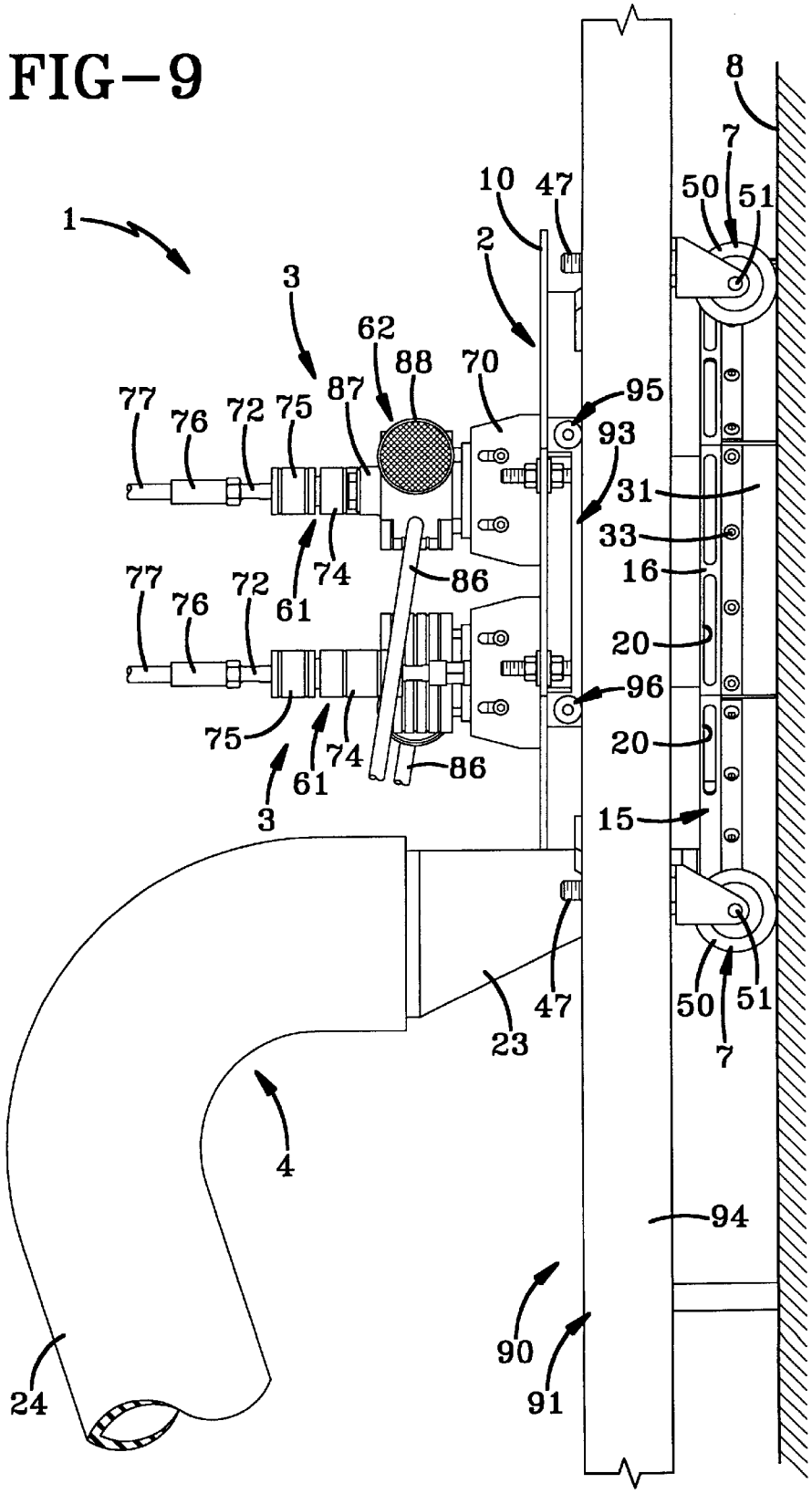
FIG. 9 is a side elevational view of the high pressure cleaning and removal system of FIG. 5 attached to and movable within a wall track mechanism.
Figure 10:
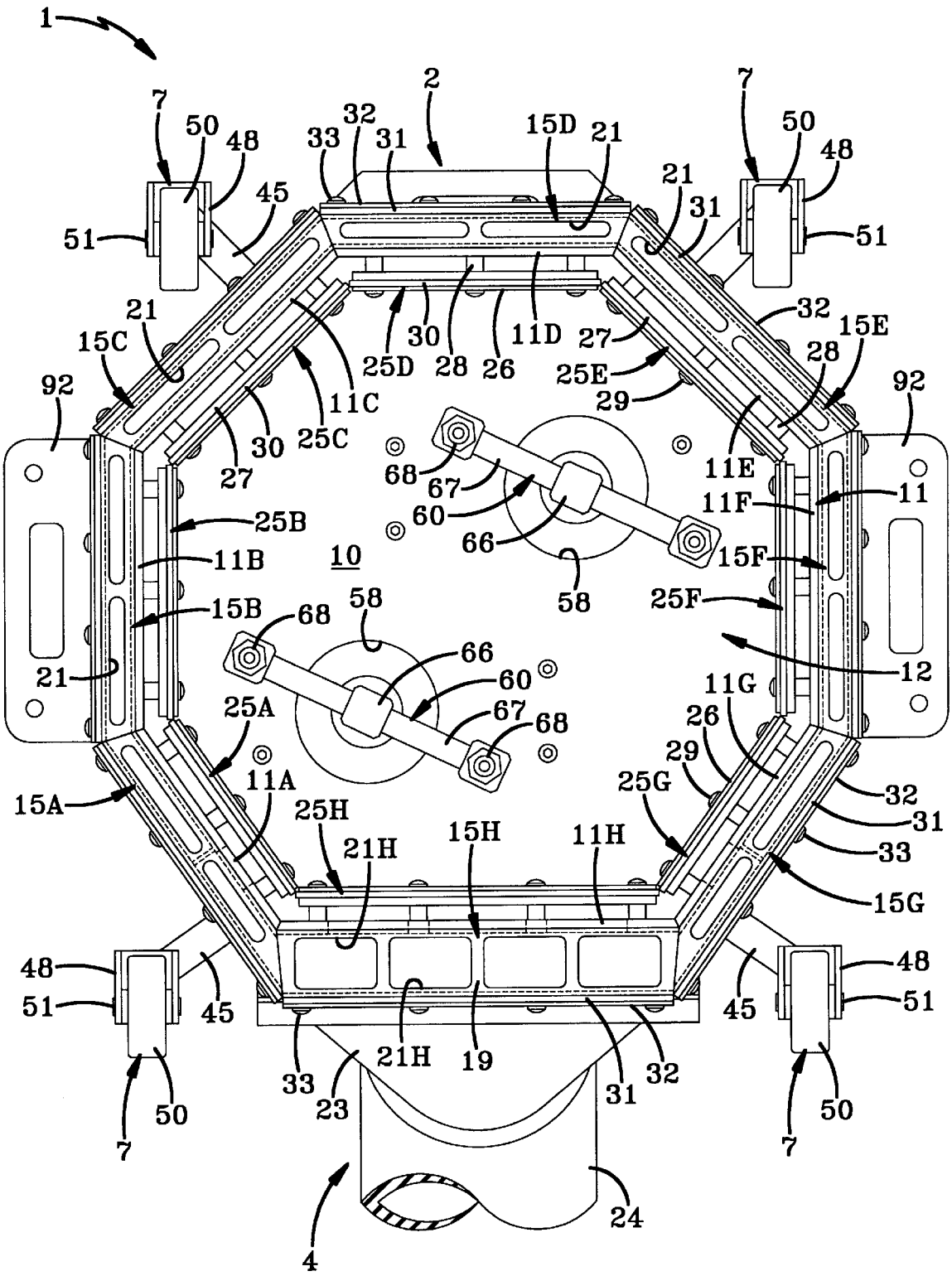
FIG. 10 is another side elevational view of the high pressure cleaning and removal system of FIG. 9 taken from underneath the housing.
Figure 11:
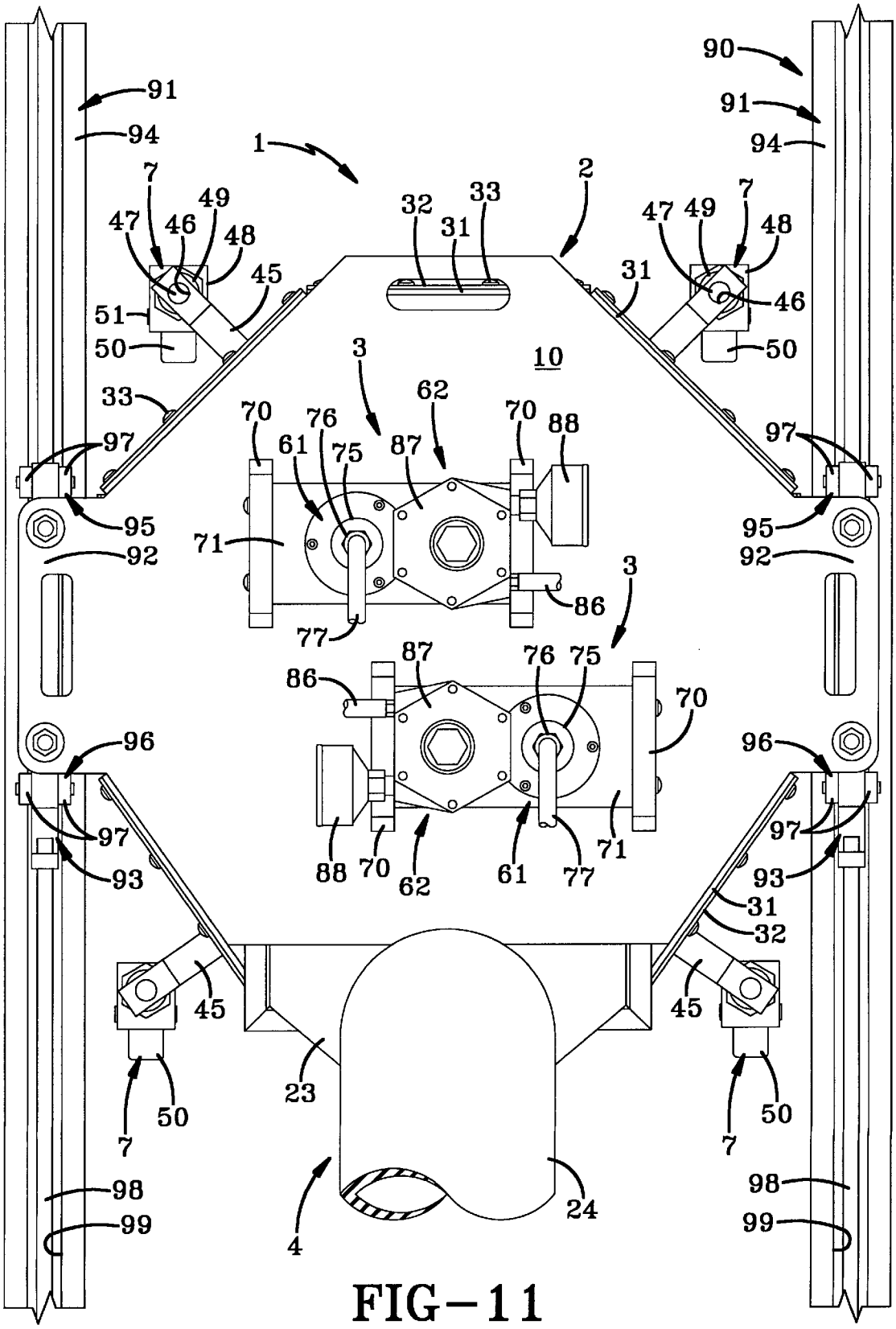
FIG. 11 is an even further side elevational view of the high pressure cleaning and removal system of FIGS. 9 and 10 taken from above the housing.
Figure 13:
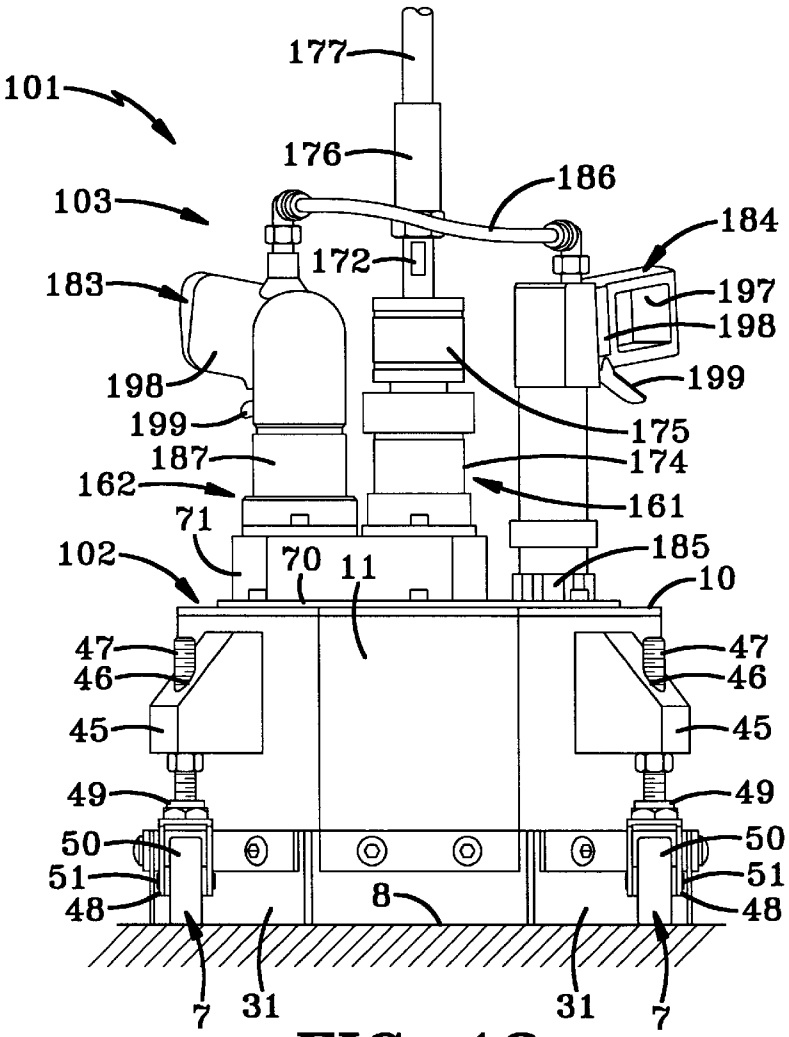
FIG. 13 is a front elevational view of the high pressure cleaning and removal system of FIG. 12.
Figure 12:
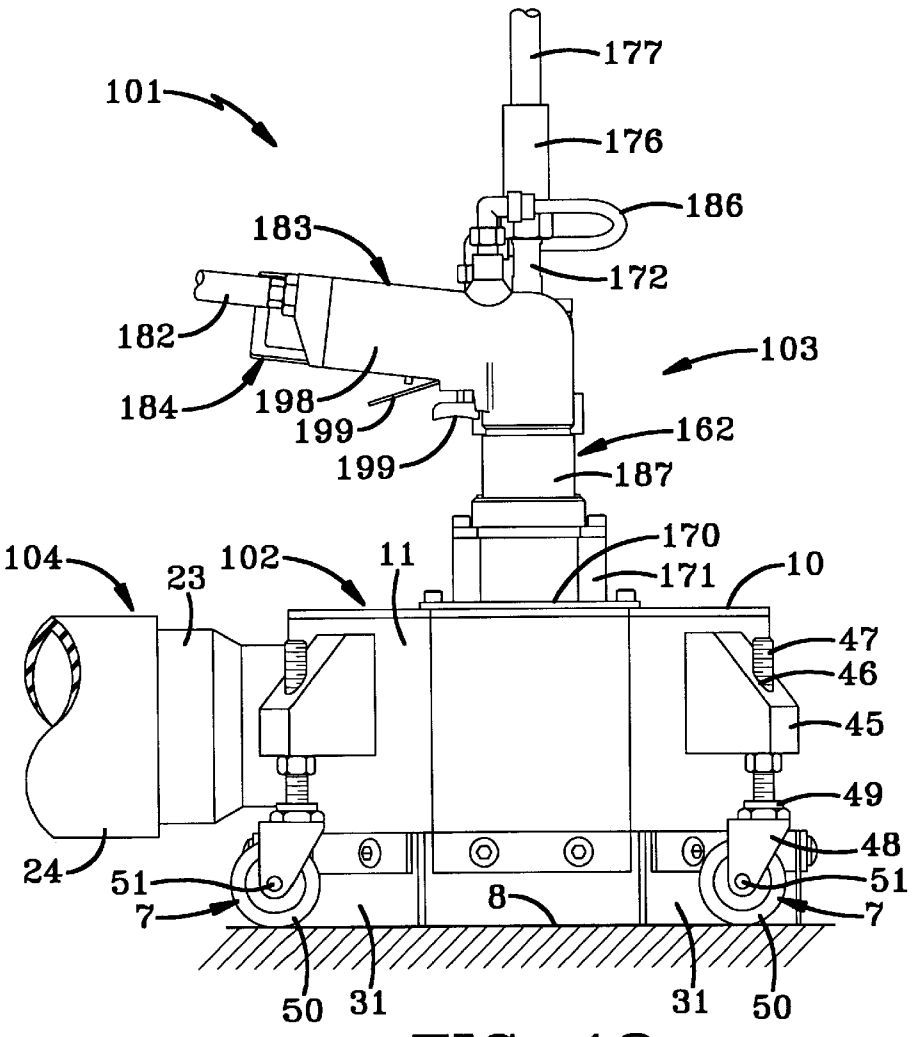
FIG. 12 is a side elevational view of a second embodiment of the high pressure cleaning and removal system.

One of the systems 1 from FIGS. 1–8 (specifically from FIG. 5) is shown in FIGS. 9–11 attachable to a track or rail system 90 so that the large housing 2 can be used vertically rather than horizontally or on a slope as preferred with the embodiments of FIGS. 1–8. This allows for the cleaning of walls or exterior surfaces on buildings for example.

The track or rail system 90 includes a pair of spaced apart and parallel tracks 91 in which the system 1 rides. The housing 2 includes a pair of flanges 92 extending from the outer surface, and preferably the plate 10, of the housing 2 about opposite sides thereof. The flanges 92 have slide mechanisms 93 thereon for interacting with the tracks 91 so as to allow the housing 2 to move along the tracks in a manner in which the housing is pinned in between the tracks and against the surface 8 to be cleaned.

Slide mechanisms 93 may be any type of ball bearing, bearings, wheels, slides, casters, smooth surface, C-channel, etc. which allows the housing 2 to slide over or along the tracks 91. Similarly, the tracks 91 may be any type of elongated guide which allows sliding of the housing 2 and guides or holds the housing also, such as a rail, track, channel, C-channel, grooved or slotted structure, etc. It is intended that the tracks 91 may be affixed to the surface to be cleaned in any known manner including using fasteners or banding the tracks around the entire structure.

In one version, the tracks 91 are C-channels 94 with an elongated slot 95 therein of a lesser width than the hollow interior of the channel, and the slide mechanism 93 are two pair of wheels 95 and 96, each pair including an inner wheel (not shown) which rides and is slidable within the C-channel 94 but not removable through the slot 95 of the C-channel thereby holding the housing 2 adjacent to the track 91, and an outer wheel 97 (FIG. 11) which rides on the outside of the C-channel 94 over the open slot 95 therein. Each pair of wheels is affixed to the flange 92.

A pull cable 98 is provided for moving the housing 2 up and down within the tracks 91. Preferably, this pull cable 98 is attached to an actuator such as a winch or other cable motion device.

A second embodiment is shown in FIGS. 12–15 which is an intermediate size (the first embodiment being of a large size) and lighter-weight hand-held unit in comparison to the larger push and/or pull units of FIGS. 1–11. Specifically, the second embodiment is shown in FIGS. 12–15 and generally indicated as 101. The housing, now indicated as 102, is of a substantially identical design, configuration, and shape, but is of a smaller size than the housing 2 in FIGS. 1–11. Each of the parts of system 101 that is identical of substantially identical to those of system 1 as previously described is similarly numbered as in system 1. (Each of these elements will not be re-introduced unless differences need to be pointed out between the new element and the previously introduced element.) However, one difference is that on intermediate sized or smaller units, the slots 22 are not necessary as the surface area to be vacuumed is such that the additional air is not needed.

As to the cleaning mechanism, now indicated as 103, and particularly its main features of the washing head, high pressure water system, and rotation providing mechanism, the handle 5 is removed and a trigger assembly replaces it in which the washing head, high pressure water system and rotation providing system are all attached on the plate 10 of the housing 102 as is shown in FIGS. 12–15. Specifically, the washing head, which is indicated as 160, is of a smaller dimension but is still rotatably mounted within the cavity 12. Basically, washing head 160 includes a rotatable main feed 65, a "T" or other branching fitting 66, one or more branch feeds 67, and a plurality of jets 68 on each branch feed just as the larger washing head does so the main difference is overall length. However, the high pressure water system and rotation providing system are substantially different and are therefore numbered accordingly.

The high pressure water system of the second embodiment is indicated as 161 and the rotation providing system of the second embodiment is indicated as 162. The high pressure water system 161 includes a mounting bracket 170, a gear box 171, a gear box drive shaft 172, a swivel within a swivel housing 174, a swivel nut 175, a hose fitting 176, an ultra high pressure water hose 177, and an ultra high pressure water supply (remotely located and not shown). Mounting bracket 170 is mounted on the top surface of plate 10 over hole 58. Gear box 171 is mounted within mounting bracket 170. Gear box drive shaft 172 extends through the gear box 171 and is rotatably driven by the gear box 171. Attached to one end of the drive shaft 172 is the washing head 160 and attached to the other end of the drive shaft 172 is the swivel housing 174 and the swivel nut 175. The swivel housing 174 and swivel nut 175 remain stationary while the drive shaft 172 rotates as the swivel nut provides a connection for the hose fitting 176 on the end of the water hose 177 to the drive shaft 172 which is hollow with a fluid passage therein to the washing head 160. The swivel housing 174 and swivel nut 175 allow the drive shaft to rotate from within while remaining stationary, and provide a fluid connection of the stationary water hose 177 to the rotatable drive shaft 172.

The rotation providing mechanism 162 includes a main air supply hose 182, a first trigger assembly 183, a second trigger assembly 184, a safety handle and second trigger base 185, a trigger connection hose 186, an air motor 187, a muffler 188, and an air return hose 189. The air motor 187 is attached to the gear box 171 for providing air for driving the drive shaft 172. The air supply hose 182 connects the remote pressurized air supply to the first trigger assembly 183 while the trigger connection hose 186 connects to the first trigger assembly to the second trigger assembly 184 and the air return hose 189 connects back to the remote pressurized air supply thereby completing the fluid circuit. Each trigger assembly 183 and 184 includes a trigger body 198 and a trigger 199. The second trigger assembly also includes a handle hole 197. The triggers control the air and water flow through air hoses 182,186 and 189 and water hose 177. When both triggers 199 are actuated, the air is allowed to pass through the hoses thereby actuating the air motor 187. The air then drives the drive shaft 172. In addition, water is allowed through the water hose 177 into the swivel housing and nut 174 and 175 whereby the water passes into the rotating drive shaft 172 and washing head 160 for high pressure distribution via jets on the head. The double triggers serve as a safety feature since both triggers must be actuated to activate the system.

Furthermore, the addition of the air return hose 189 alters the system such that instead of simultaneous actuation of the rotation providing mechanism and the high pressure water system as occurs in the first-fourth embodiments (FIGS. 1–11), this fifth embodiment incorporates a sequential system where the rotation providing mechanism is actuated by the first trigger, but the high pressure water system is not activated until the second trigger is actuated thereby providing pressurized fluid back through the air return hose 189 to activate the high pressure water system.

Figure 14A:
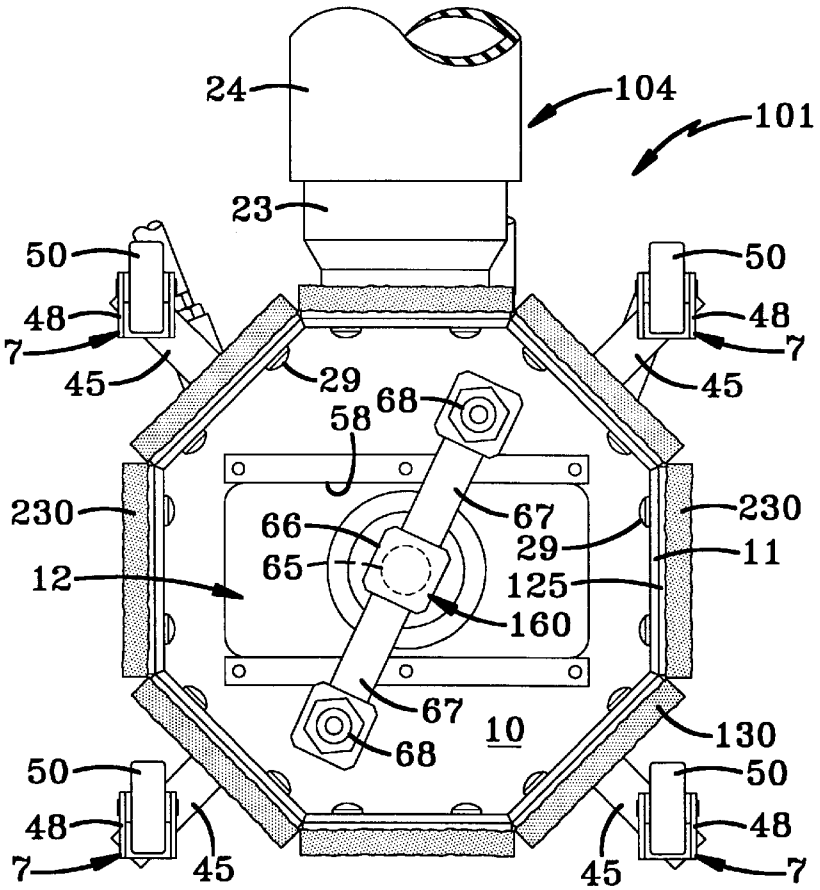
FIG. 14*a* is a bottom plan view of the high pressure cleaning and removal system of FIGS. 12–14 with a modified seal.
Figure 14:
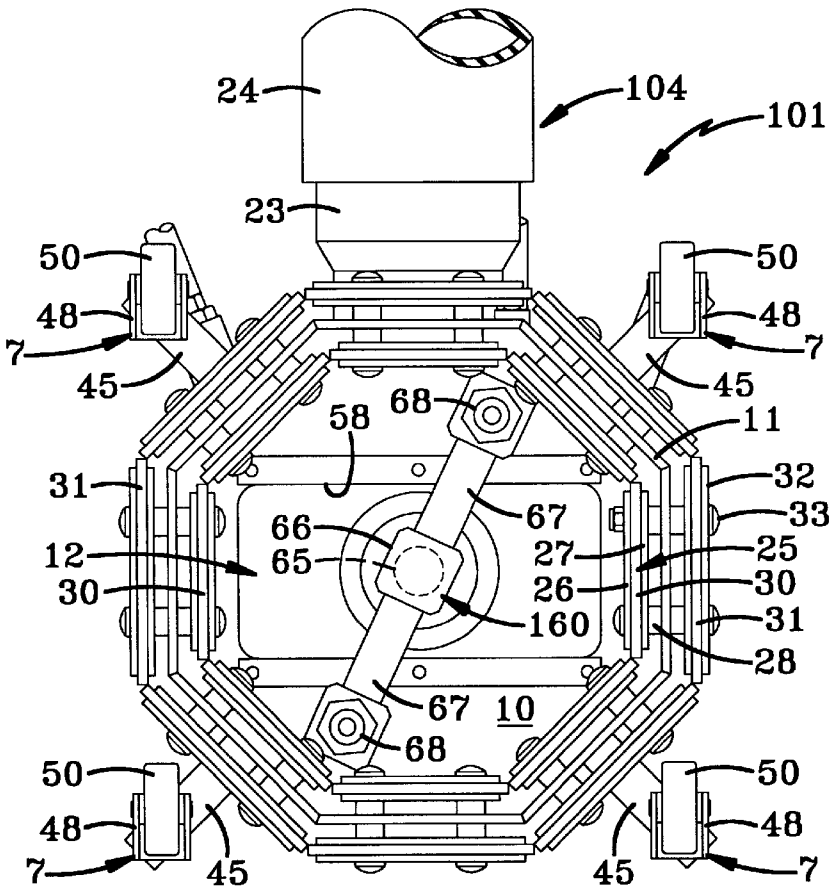
FIG. 14 is a bottom plan view of the high pressure cleaning and removal system of FIGS. 12 and 13.
Figure 15:
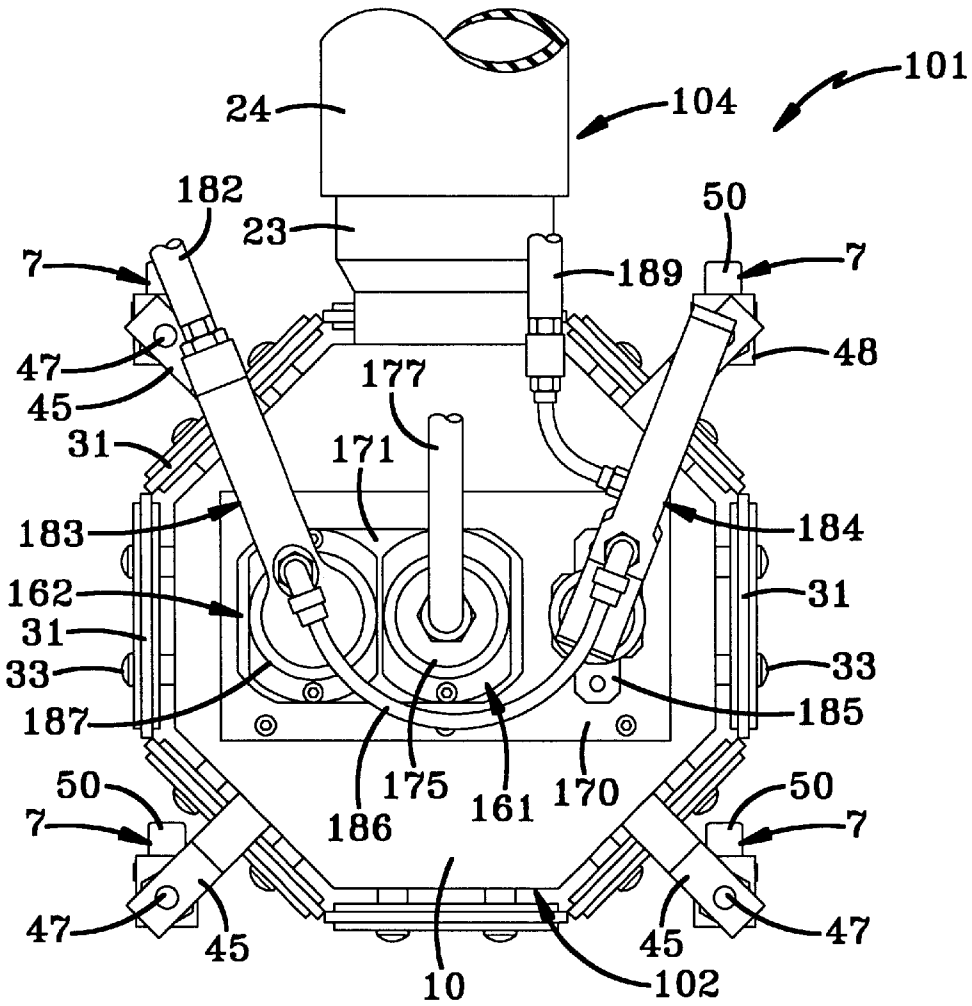
FIG. 15 is a top plan view of the high pressure cleaning and removal system of FIGS. 12–14.
Figure 17:
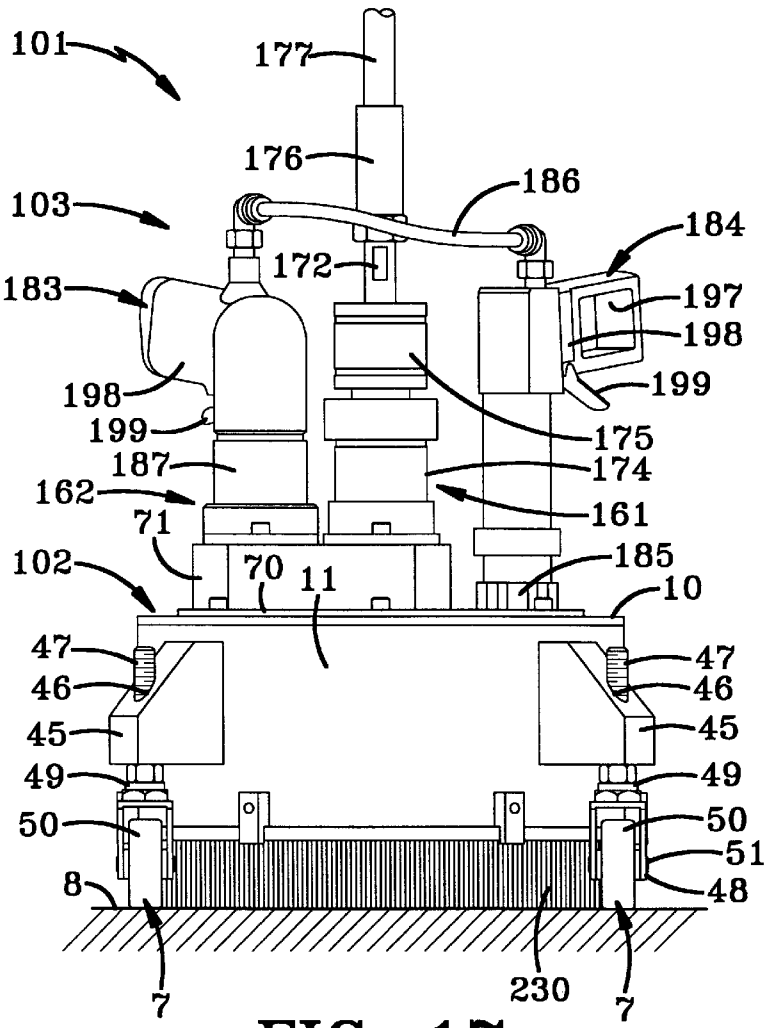
FIG. 17 is a front elevational view of the high pressure cleaning and removal system of FIG. 16.
Figure 16:
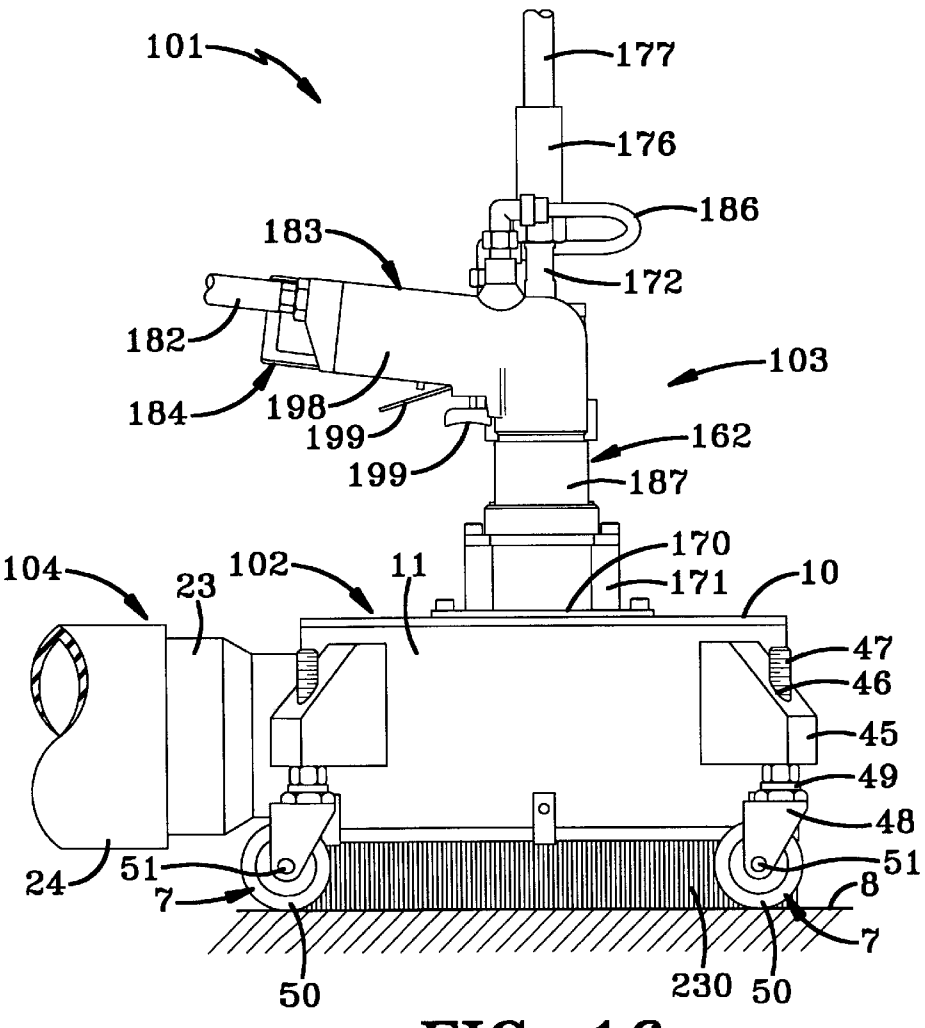
FIG. 16 is a side elevational view of the second embodiment of the high pressure cleaning and removal system with a different housing.
Figure 19:
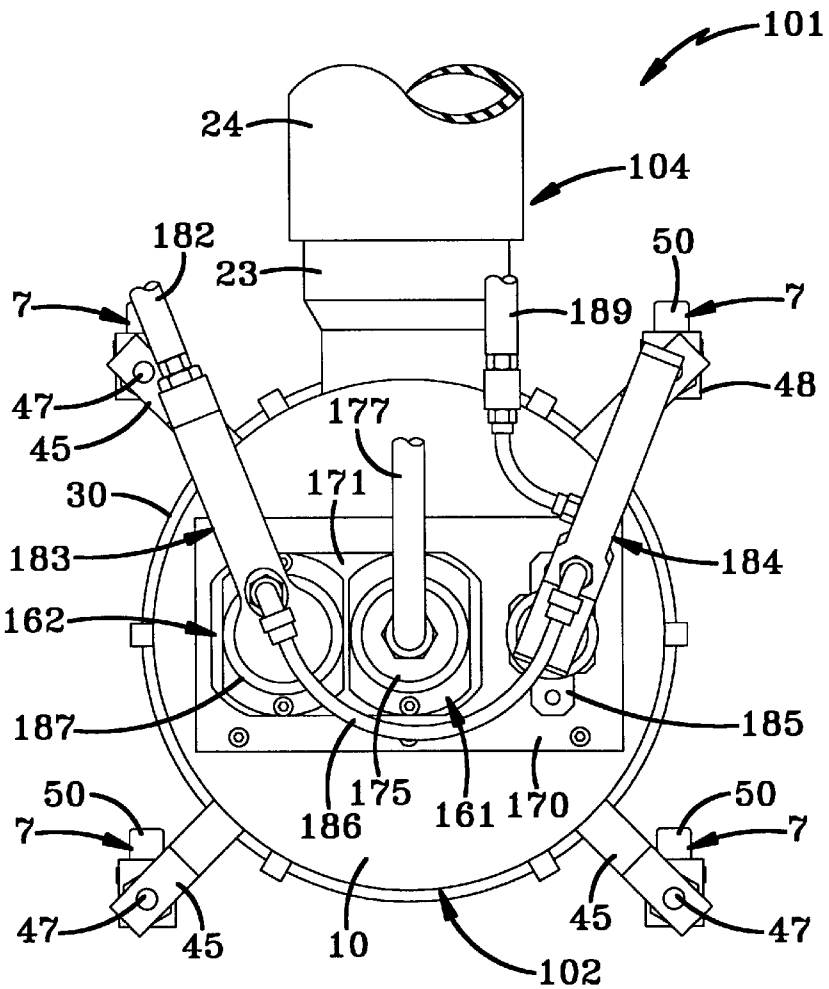
FIG. 19 is a top plan view of the high pressure cleaning and removal system of FIGS. 16–18.
Figure 18:
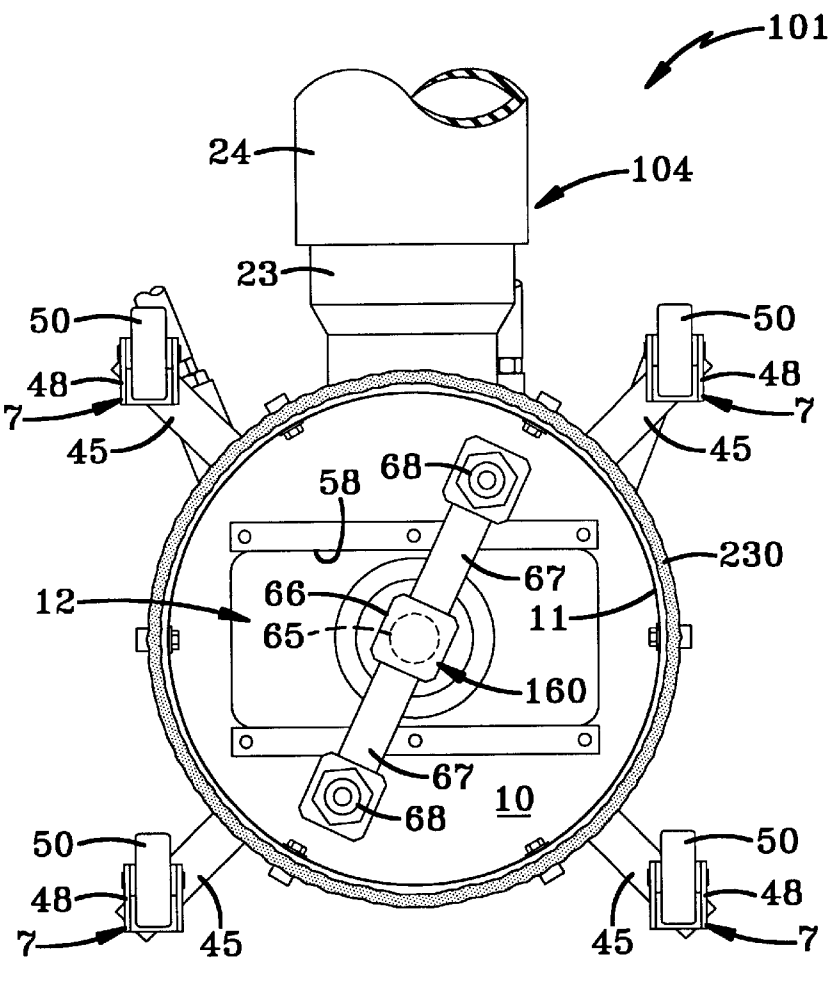
FIG. 18 is a bottom plan view of the high pressure cleaning and removal system of FIGS. 16 and 17.

A modified version is shown in FIG. 14A where the sealing members 30 and 31 are replaced by brushes 230. Also, the tortuous path 35 and all of its components including support plate 25, hollow member 15, etc. are replaced merely by an attachment plate 125 that affixes the brushes 230 to the outermost edge of the wall 11.

A modified version is shown in FIGS. 16–19 as system 201 which incorporates the size of the system 101 with the brushes 230 of FIG. 14A and lack of a tortuous path of the system 101 with a housing shape change from an octagon to a cylinder. Otherwise, system 201 is substantially identical to system 101 and is thus identically numbered. It is contemplated as described above that the housing could be shaped of any polygonal shape, a round shape, an oval shape or any non uniform shape so long as the cavity is capable of housing a washing head and being sealable so that water and material does not escape the cavity.

It is further contemplated that the outermost surface of the system, which is generally the sealing surface that rides along the surface to be cleaned, need not be planar since many non-planar areas exist in which cleaning is required such as inner and outer corners of both a 90° or other acute or obtuse angle. Examples of a few such embodiments are shown in FIGS. 20–27.

A third embodiment of the high pressure cleaning and removal system is shown in FIGS. 20–23 and generally indicated as 301. This embodiment is a small hand-held unit for cleaning outer corners of approximately a 90° angle. The size of this unit is smaller than both the large and intermediate sized units described above and it lacks the tortuous path and double sealing members as used with the above units since these are not needed to assure no leakage and proper vacuum. The high pressure water system 161 and the rotation providing mechanism 162 of this third embodiment are identical or substantially identical to that of the second embodiment as described in detail above (and are thus similarly numbered to the second embodiment as shown in FIGS. 12–16. The housing, indicated as 302, of this third embodiment is smaller than the above described embodiments and is of a square shape, and lacks the tortuous path and double sealing member construction of the larger designs, but is otherwise similar and thus similarly numbered. The sealing member is a brush 330 extending around the square perimeter of the housing (although it is contemplated that it could be a rubber seal or other sealing member). Specifically, the sealing member is a set of brushes 330A, 330B, 330C and 330D, each fastened to the housing.

Figure 21:
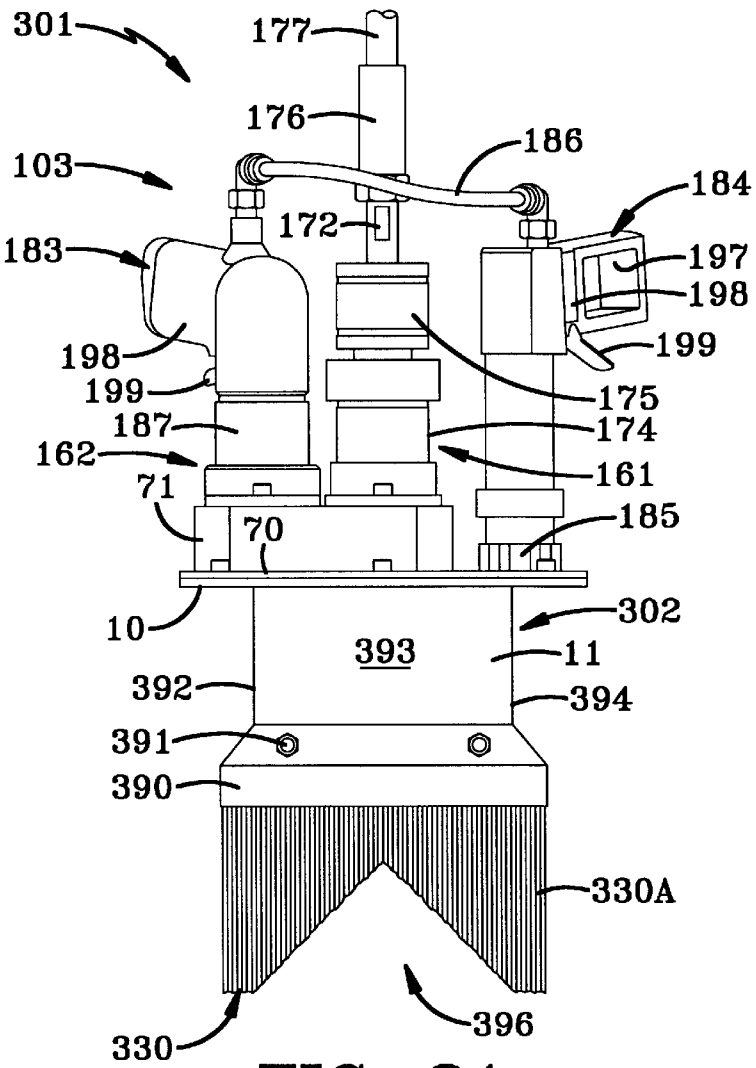
FIG. 21 is a front elevational view of the high pressure cleaning and removal system of FIG. 20.
Figure 20:
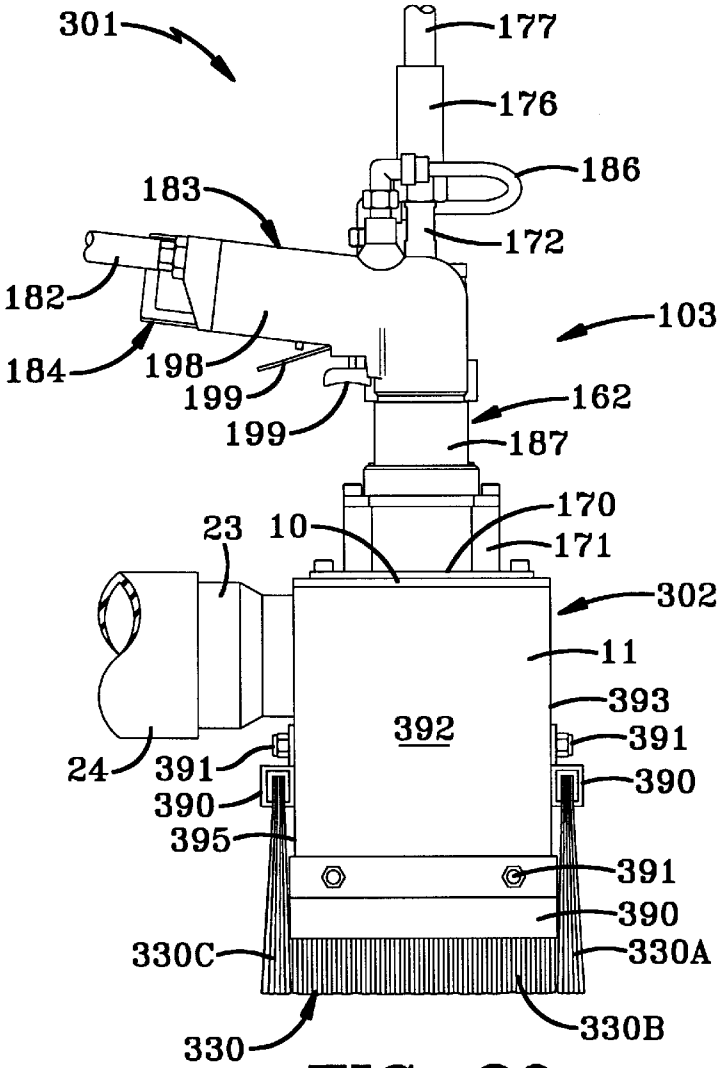
FIG. 20 is a side elevational view of a third embodiment of a high pressure cleaning and removal system.
Figure 23:
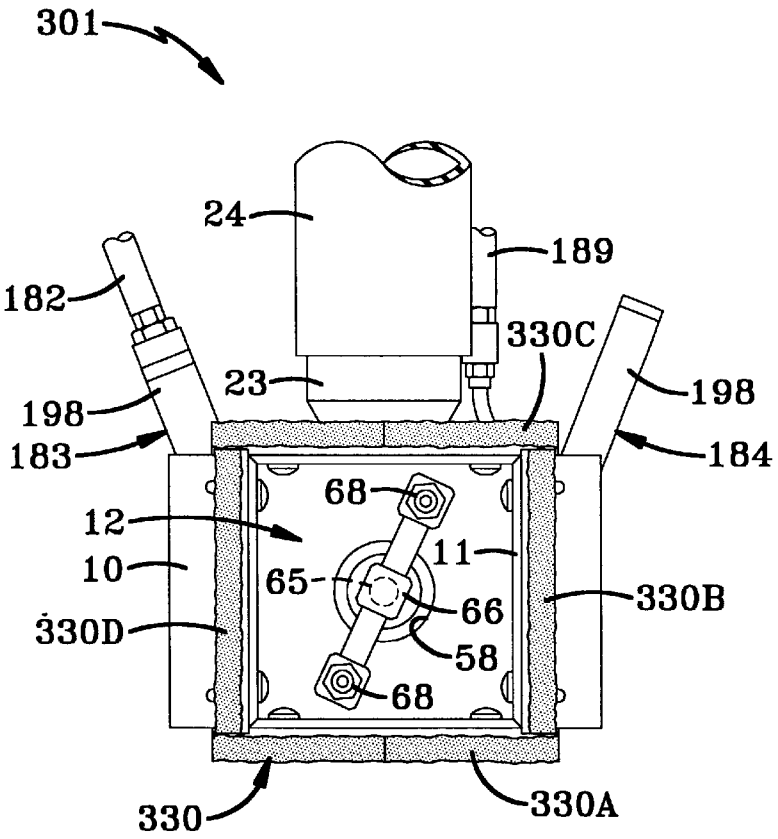
FIG. 23 is a bottom plan view of the high pressure cleaning and removal system of FIGS. 20–22.
Figure 22:
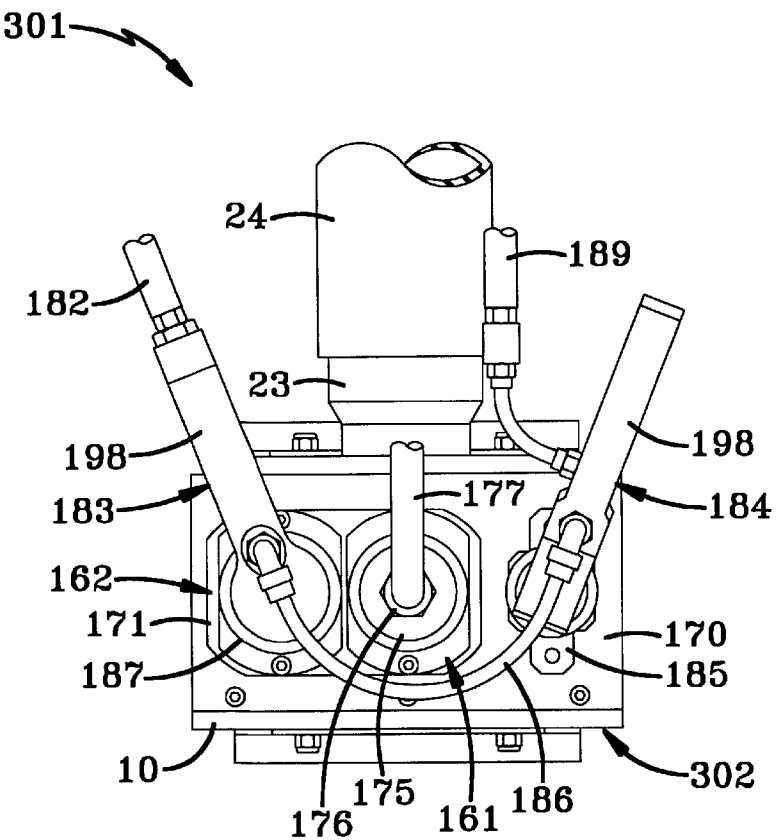
FIG. 22 is a top plan view of the high pressure cleaning and removal system of FIGS. 20 and 21.

In the embodiment as shown, the housing 302 includes mounting plates or channels 390 in which the brushes 330 are held. These mounting plates 390 are affixed to the housing 302 using fasteners 391. The housing 302 is designed such that the sides 392 and 394 extend outward further than the front 393 and back 395 as is shown in FIG. 20. This allows shorter bristles to be used which are more rigid. As to the front 393 and back 395 as best shown in FIG. 21, the bristles are cut in an inverted V-shape 396 to account for the outer corner to be cleaned. The housing can either have a similar V-shape or it may have a square edge that does not extend outward as far as the sides so as to account for the valley in the V.

Figure 25:
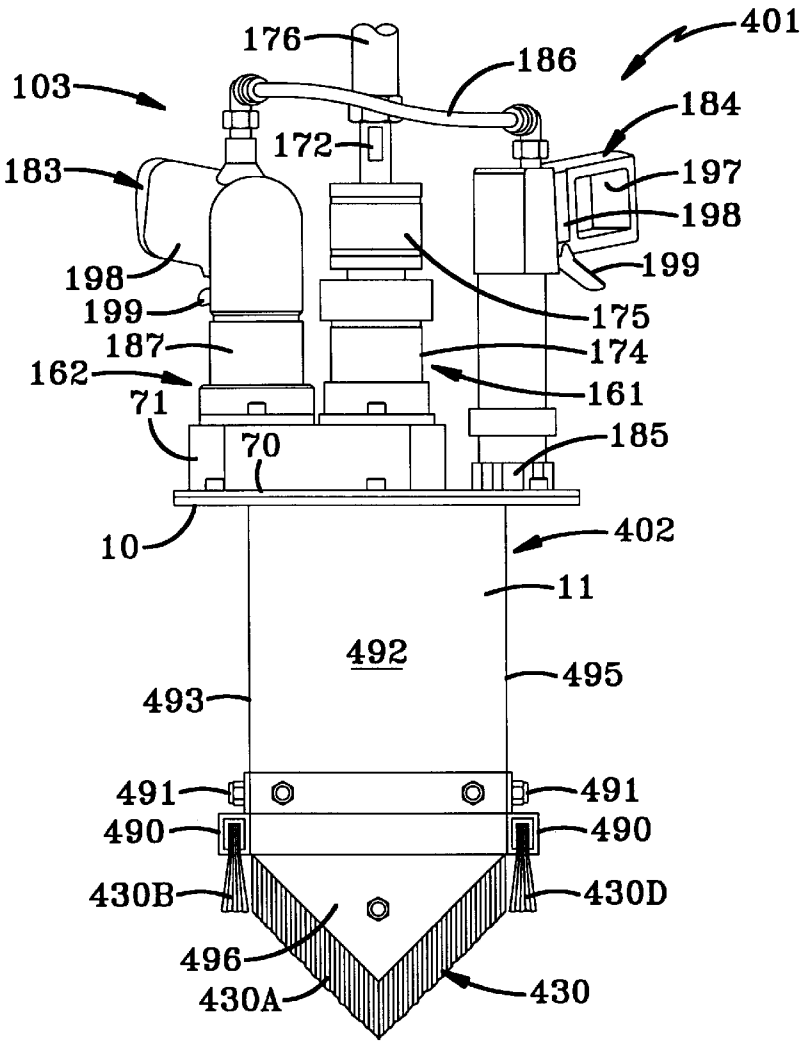
FIG. 25 is a front elevational view of the high pressure cleaning and removal system of FIG. 24.
Figure 24:
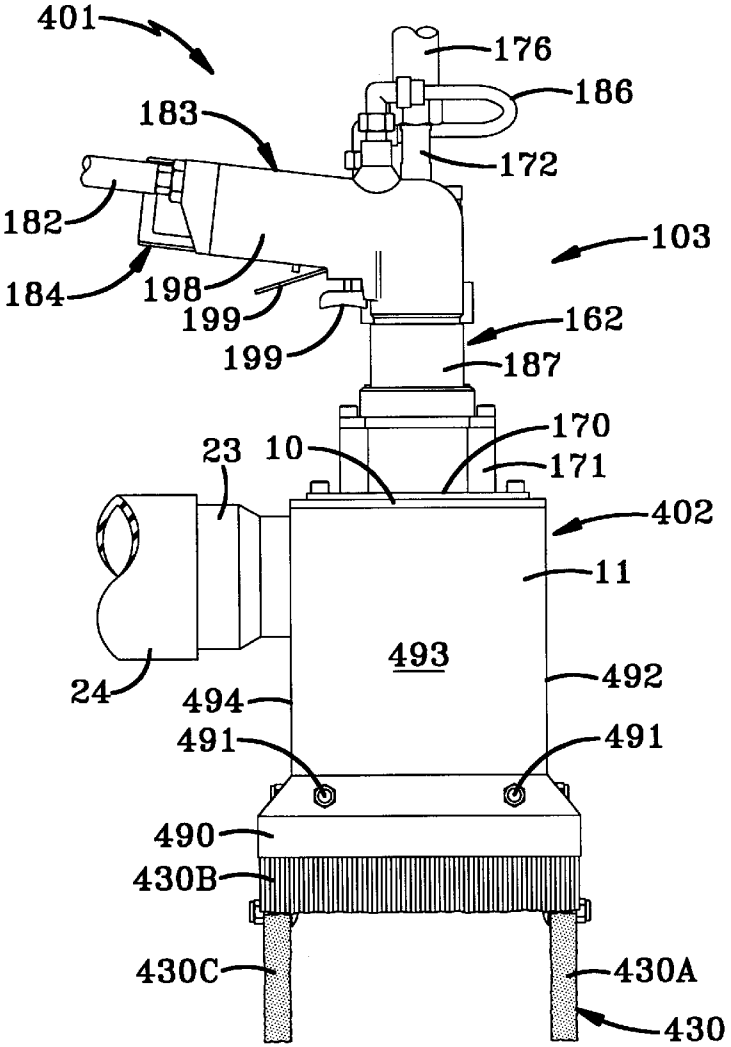
FIG. 24 is a side elevational view of a fourth embodiment of the high pressure cleaning and removal system.

A fourth embodiment of the high pressure cleaning and removal system 401 is shown in FIGS. 24–25. This embodiment is a small hand-held unit for cleaning inner corners of approximately a 90° angle. This is also a small unit without a tortuous path or double sealing arrangement as it is not needed to assure no leakage and proper vacuum. The high pressure water system 161 and the rotation providing mechanism 162 of this fourth embodiment are identical or substantially identical to that of the second and third embodiments as described in detail above. The housing 402 of this fourth embodiment is of a similar size to the third embodiment which is smaller than the above described first and second embodiments and is of a square shape, and lacks the tortuous path and double sealing member construction of the larger designs. The sealing member is a brush 430 extending around the square perimeter of the housing. Specifically, the sealing member is a set of brushes 430A, 430B, 430C, and 430D, each fastened to the housing.

In the embodiment as shown, the housing 402 includes mounting plates or channels 490 in which the brushes 430 are held. These mounting plates 490 are affixed to the housing 402 using fasteners 491. The housing 402 is designed such that the front 492 and back 494 extend outward further than the sides 493 and 495 as is shown in FIG. 25 in a triangular or V-shaped manner 496. This allows shorter bristles to be used which are more rigid yet properly define the inner corner shape needed. As to the sides 493 and 495 as best shown in FIG. 24, the bristles are also short but follow a straight line.

Figure 27:
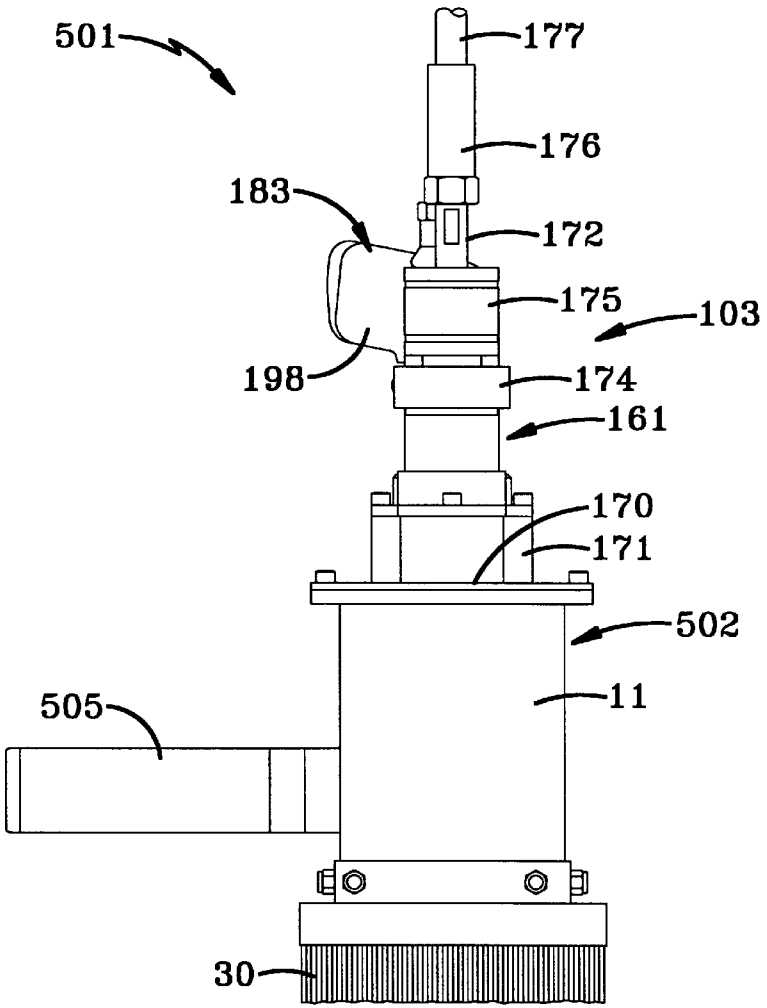
FIG. 27 is a front elevational view of the high pressure cleaning and removal system of FIG. 26.
Figure 26:
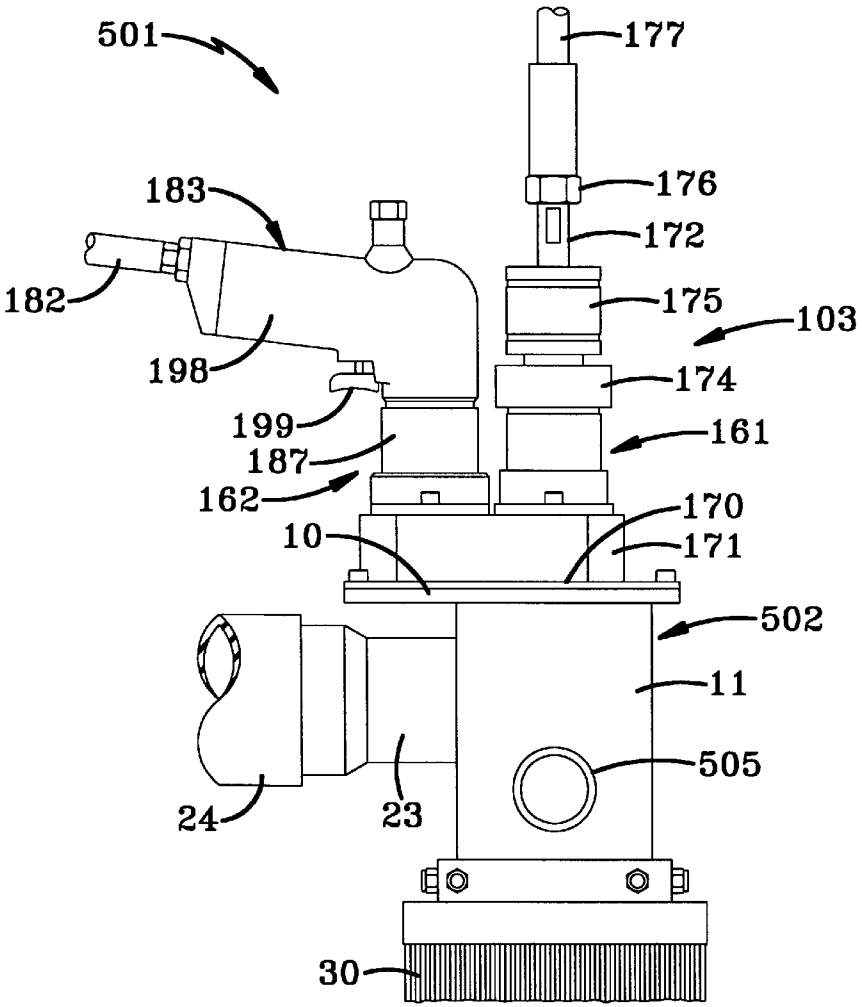
FIG. 26 is a side elevational view of a fifth embodiment of the high pressure cleaning and removal system.

A fifth embodiment of the high pressure cleaning and removal system is shown in FIGS. 26–27 and indicated generally as 501. This is the smallest of the embodiments. The housing 502 is smaller than all of the above described embodiments. In this version, only one or the first trigger 183 is used (thus the safety feature of two triggers is not used). Also, the housing 502 is basically a box construction without the tortuous path, slots, and double sealing members of the larger designs. The housing 502 does include a handle 505 as a second holding device to replace the removed second trigger, where the handle 505 extends transversely out of the side of the housing 502 as best shown in FIG. 27.

Figure 29:
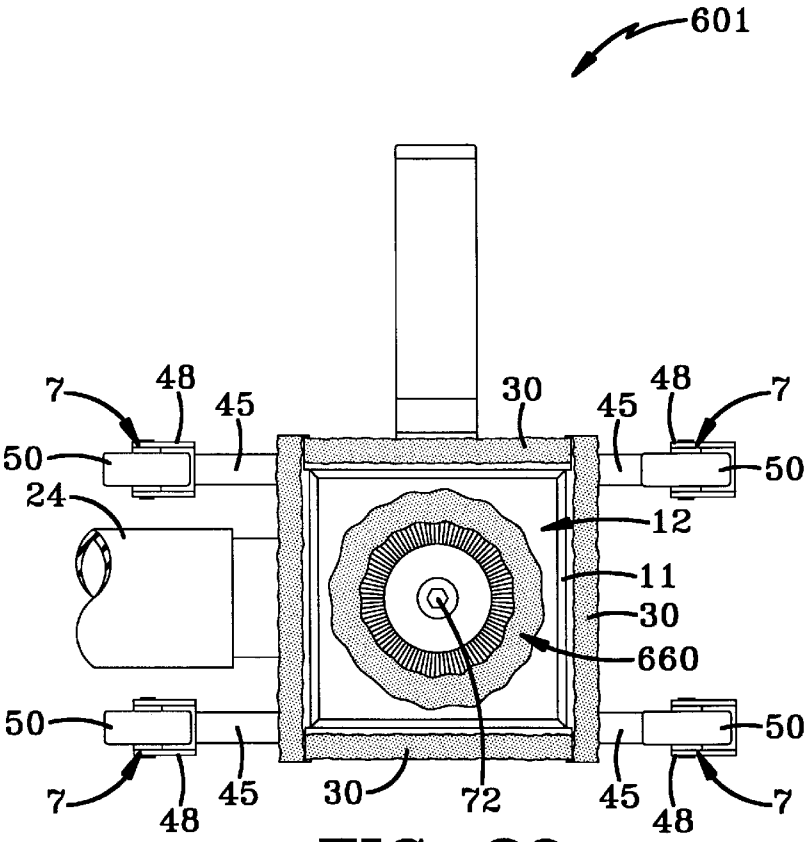
FIG. 29 is a bottom plan view of the high pressure cleaning and removal system of FIG. 28.
Figure 28:
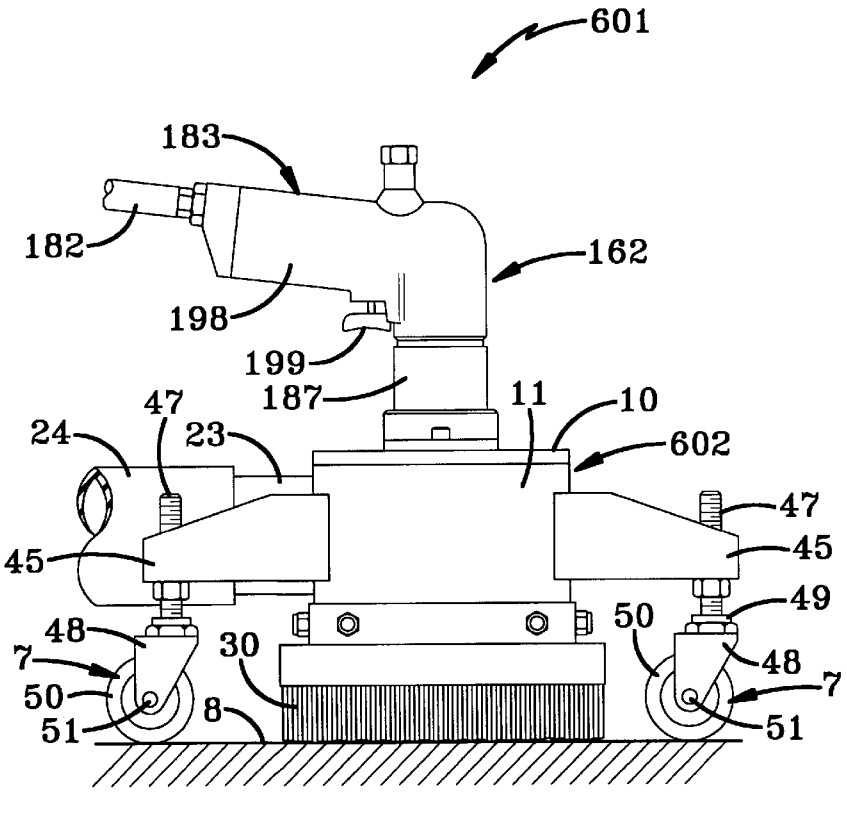
FIG. 28 is a side elevational view of a modified version of the fifth embodiment of the high pressure cleaning and removal system.

A modified version of the high pressure cleaning and removal system is shown in FIGS. 28–29 as indicated generally as 601. This embodiment selectively incorporates either or both two pair of wheels attached to the housing 602 of the fixed type 7 (although one or both sets could alternatively be of the pivotable type 6) and/or a modified washing head 660. The modified washing head 660 is a circular bristle brush that is rotatable by the drive shaft 72 in the same manner as the above described washing head. In this embodiment, the brush 660 is rotated at a high speed such that the coating and build-up is in effect scrubbed off. Water may optionally be provided under low or high pressure, where the high or ultra high pressure water assists in the removal process, while low pressure water is merely used as a conduit in which the material removed is entrained or otherwise mixed for easier vacuum removal.

Figure 30:
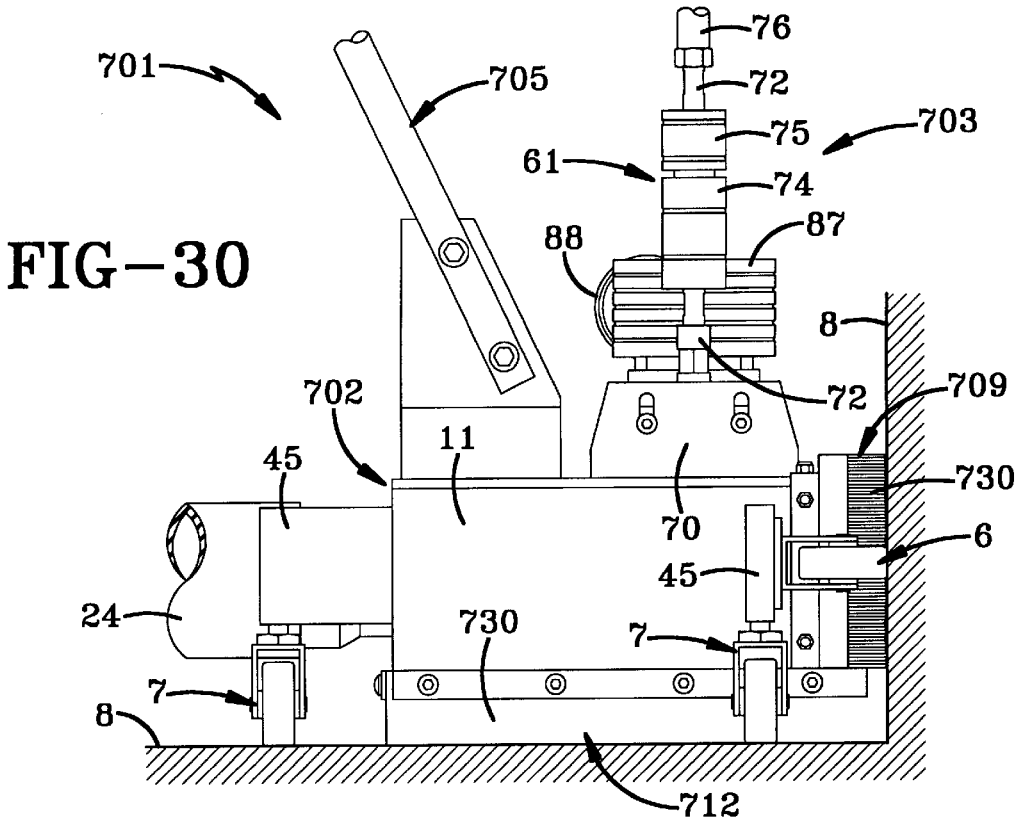
FIG. 30 is a front elevational view of a sixth embodiment of the high pressure cleaning and removal system.
Figure 31:
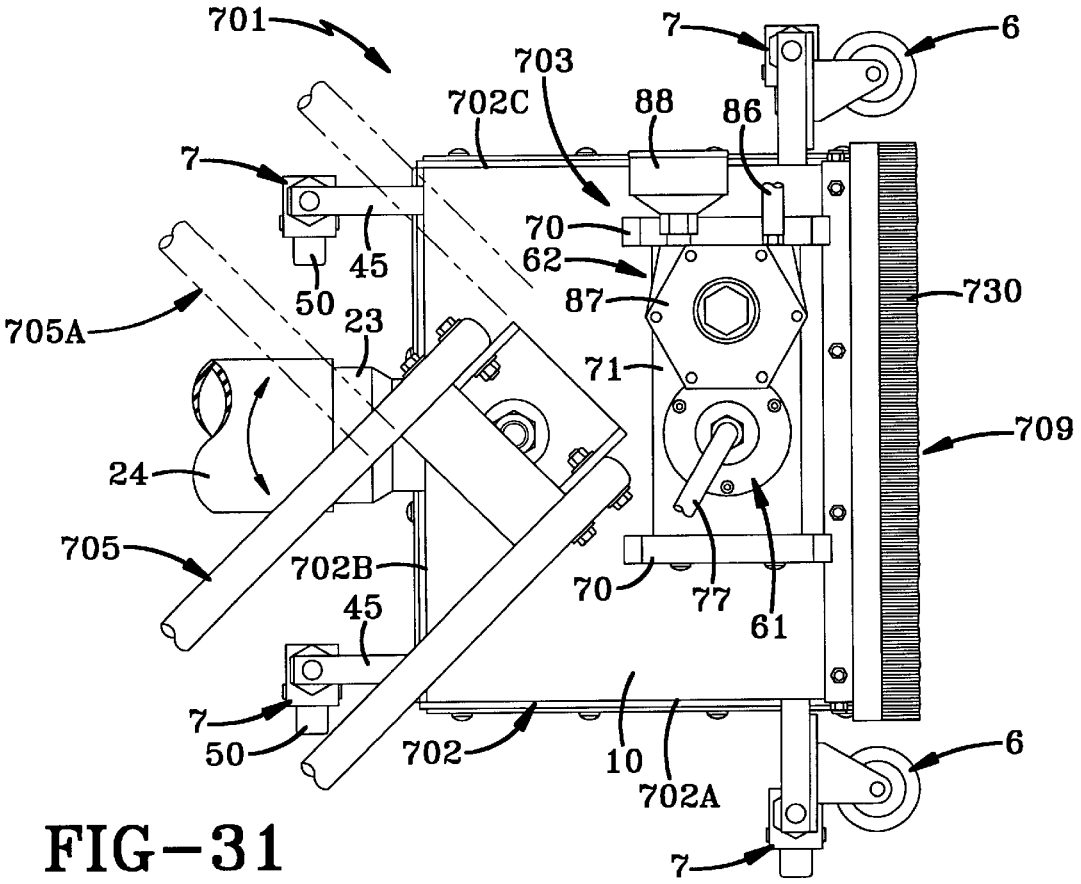
FIG. 31 is a top plan view of the high pressure cleaning and removal system of FIG. 30.

A sixth embodiment of the high pressure cleaning and removal system is shown in FIGS. 30–31 and generally indicated as 701. This embodiment is designed to clean corners along the floor where a wall and the floor meet. Rather than use the smaller above described corner units, the seventh embodiment was designed. Preferably, the housing 702 is of a square design so as to have a side area 709 for cleaning the wall while the cavity 712 on the bottom cleans the floor. The housing unit of this embodiment has one open side at side area 709 and three side walls. 702A, 702B and 702C. The open area 712 on the bottom and this open side 709 each have a sealing member 730 around its periphery. The sealing member 730 on the open area 712 is preferably a rubber seal while the sealing member 709 on the open side is a brush.

In this embodiment, the housing 702 also includes a pivotable handle assembly 705 so as to allow the system to be pushed in either direction. The handle assembly 705 shown in a first position in FIG. 31 while in a second position in shadow as 705A with an arrow showing the selective pivoting.

Figure 32:
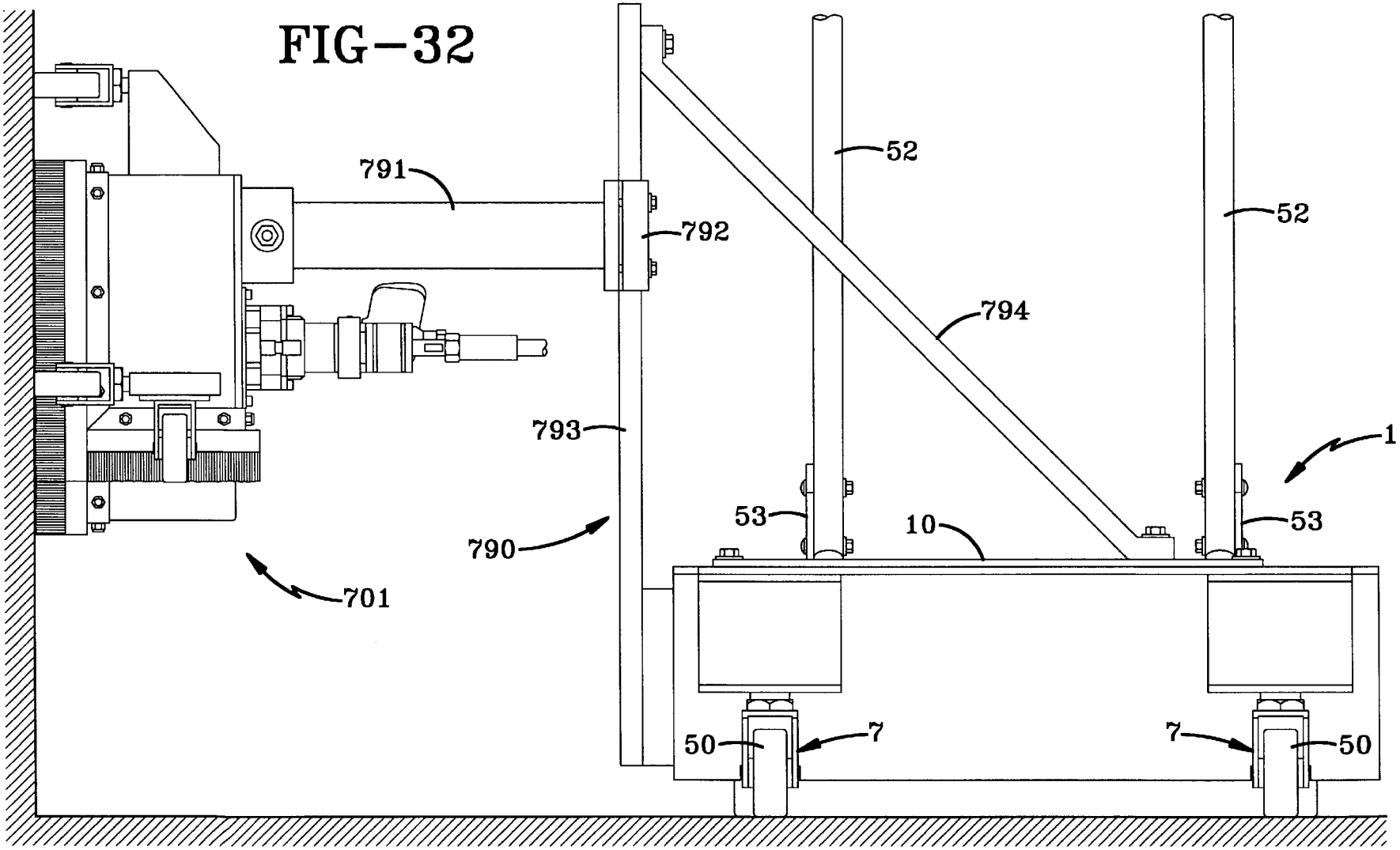
FIG. 32 is a side elevational view of the high pressure cleaning and removal system of the first embodiment coupled to the high pressure cleaning and removal system of the sixth embodiment.
Figure 33:
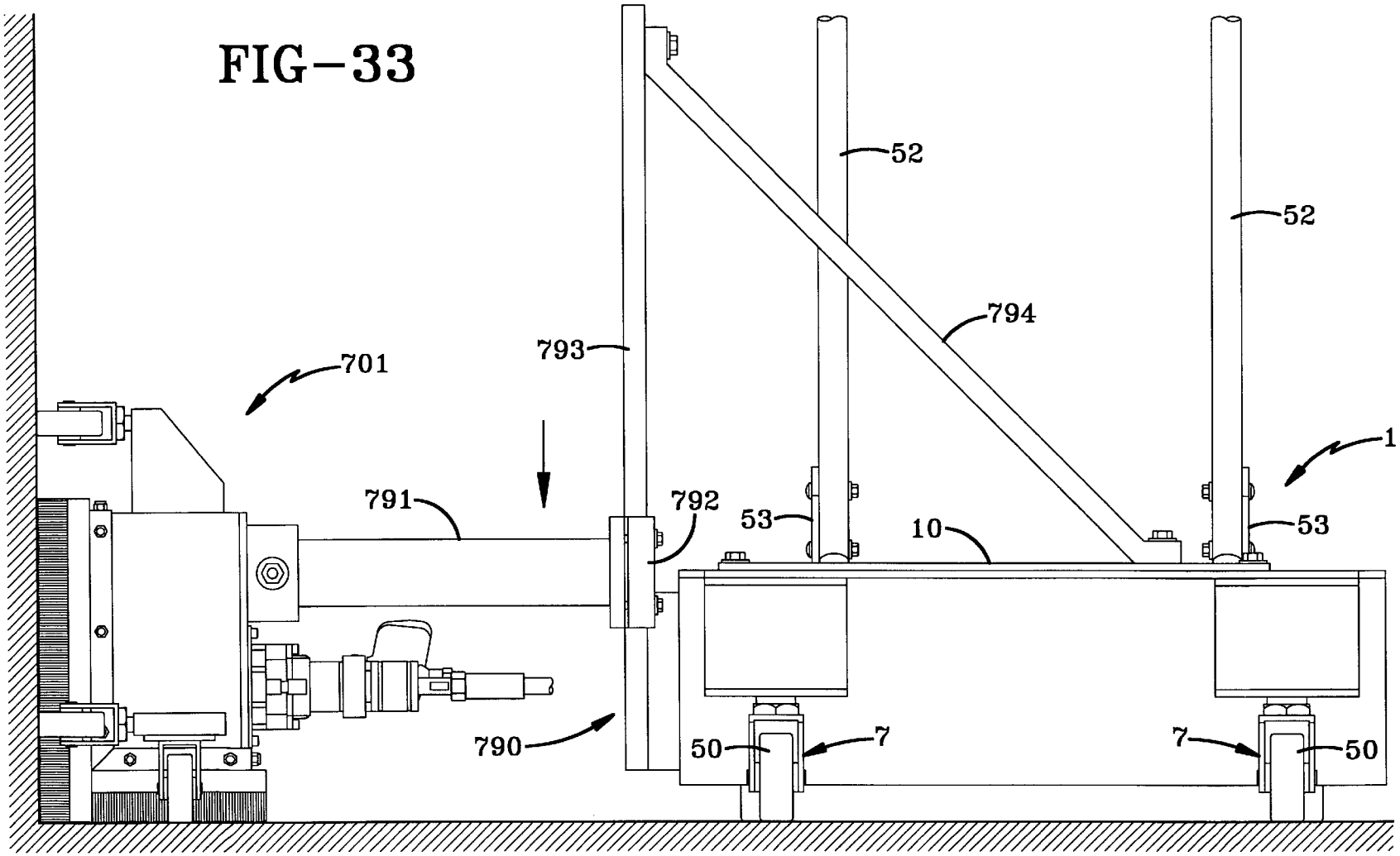
FIG. 33 is the same side elevational view of the high pressure cleaning and removal system as FIG. 32 except for a downward adjustment of a portion of the system.
Figure 34:
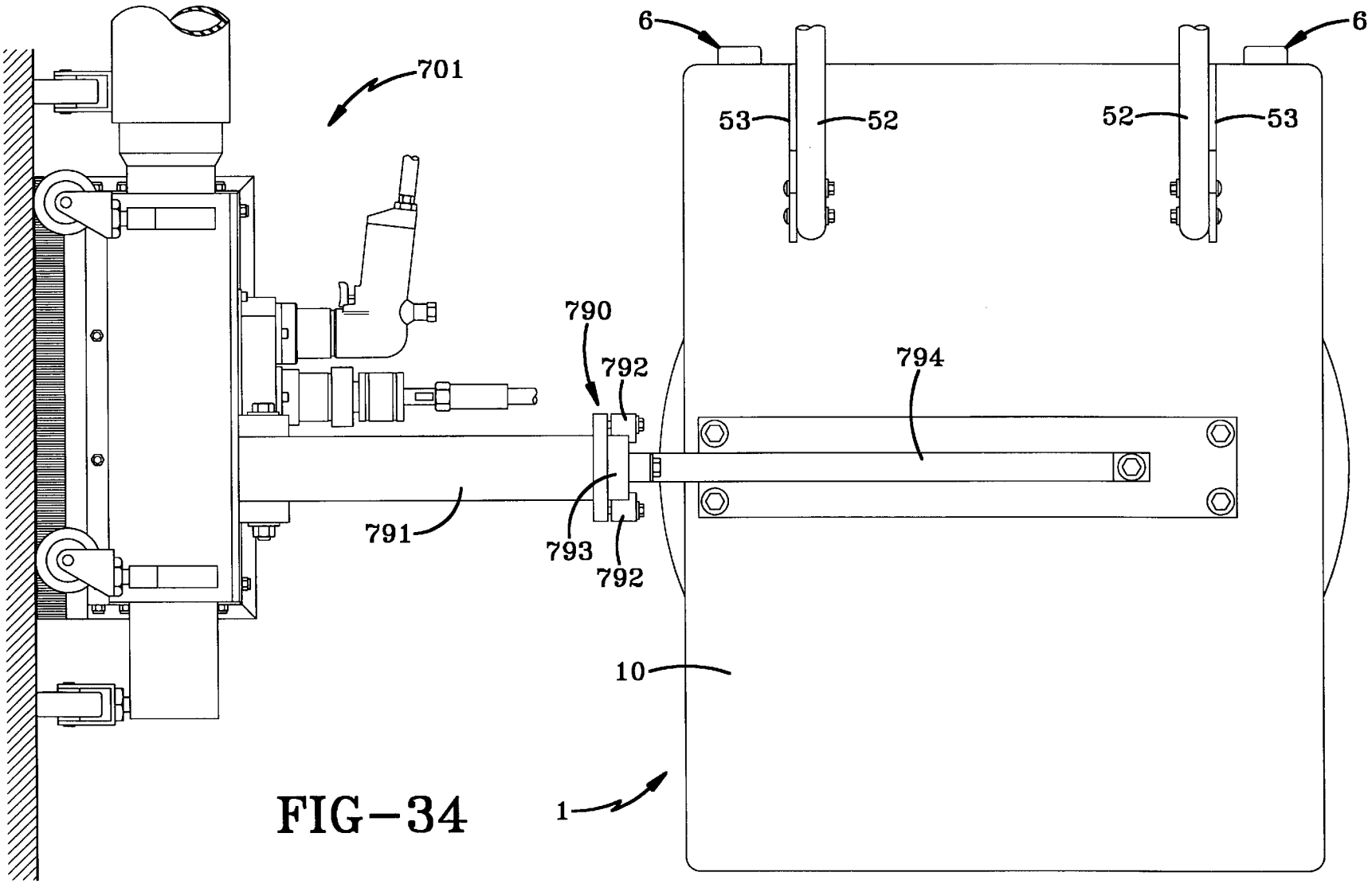
FIG. 34 is a top plan view of the high pressure cleaning and removal system of FIG. 32 and 33.

A modified high pressure cleaning and removal system is shown in FIGS. 32–34 and generally indicated as a combination of system 1 and system 701. This combination combines a large system such as that shown in FIGS. 1–11 with the sixth embodiment as shown in FIGS. 30–31. Specifically, an attachment frame 790 is attached to the plate 10 of the large system 1 for adjustably carrying a second smaller system 701 as is best shown in FIGS. 32–33. The frame 790 includes a mounting bar 791 on the second system 701 with a clamp 792 at its outer end. The frame further includes a slide bar 793 connected to the housing 2 of the first system 1 and a support bar 794 supporting the slide bar by extending from its outermost point to the housing 2 of the first system 1. The clamp is selectively engageable with the slide bar whereby the second system 701 is slidable up and down so as to allow for corner cleaning as well as cleaning the area above the floor that is often missed by the tracked wall unit as described in the version as shown in FIGS. 9–11. The drawings show the high-pressure-fluid cleaning mechanism 3 and the vacuum mechanism 4 of the system 1 removed as this is an option although such components may also be present.

Figure 35:
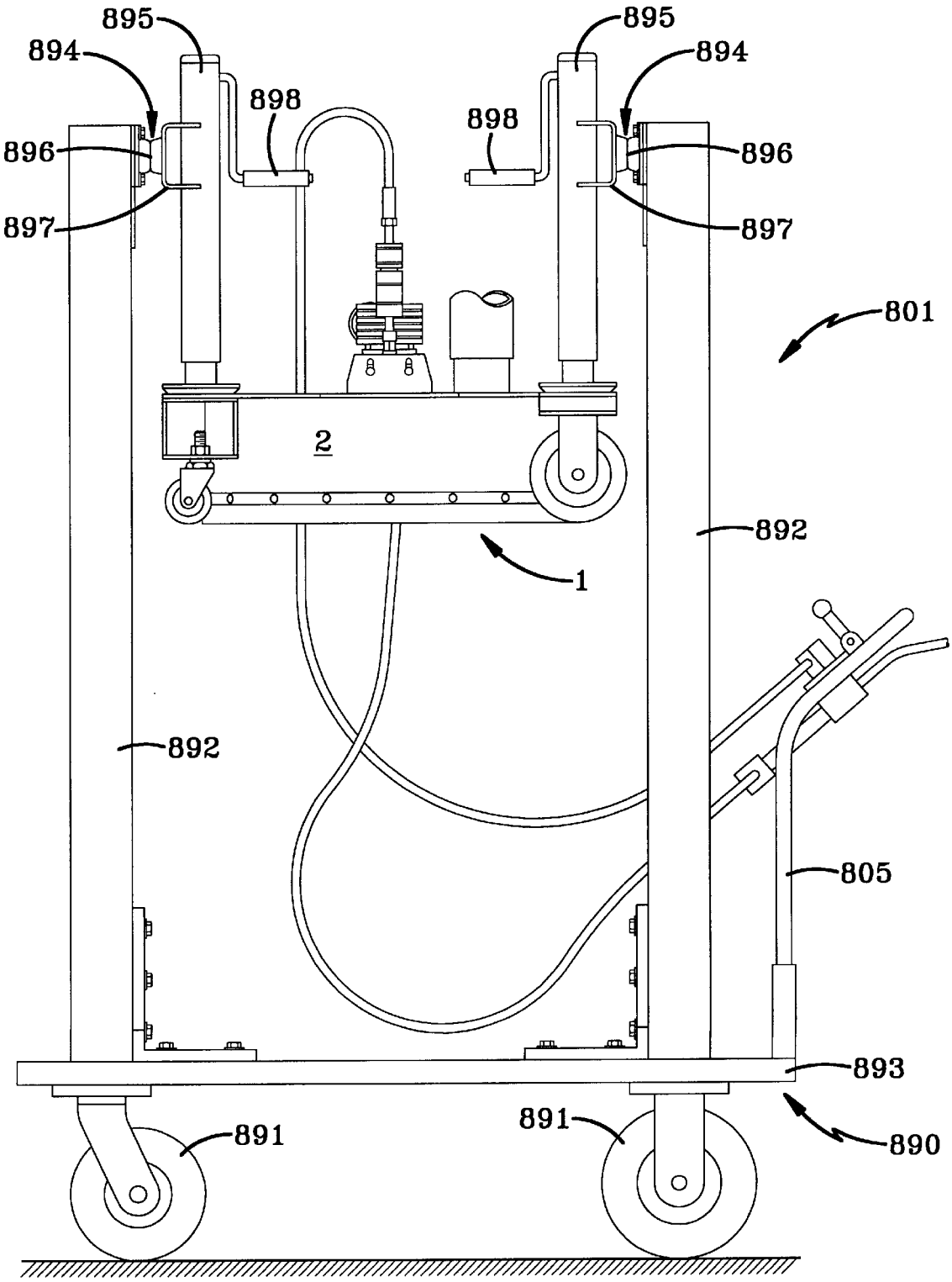
FIG. 35 is a side elevational view of a seventh embodiment of the high pressure cleaning and removal system with the cleaning apparatus shown in a down position.
Figure 36:
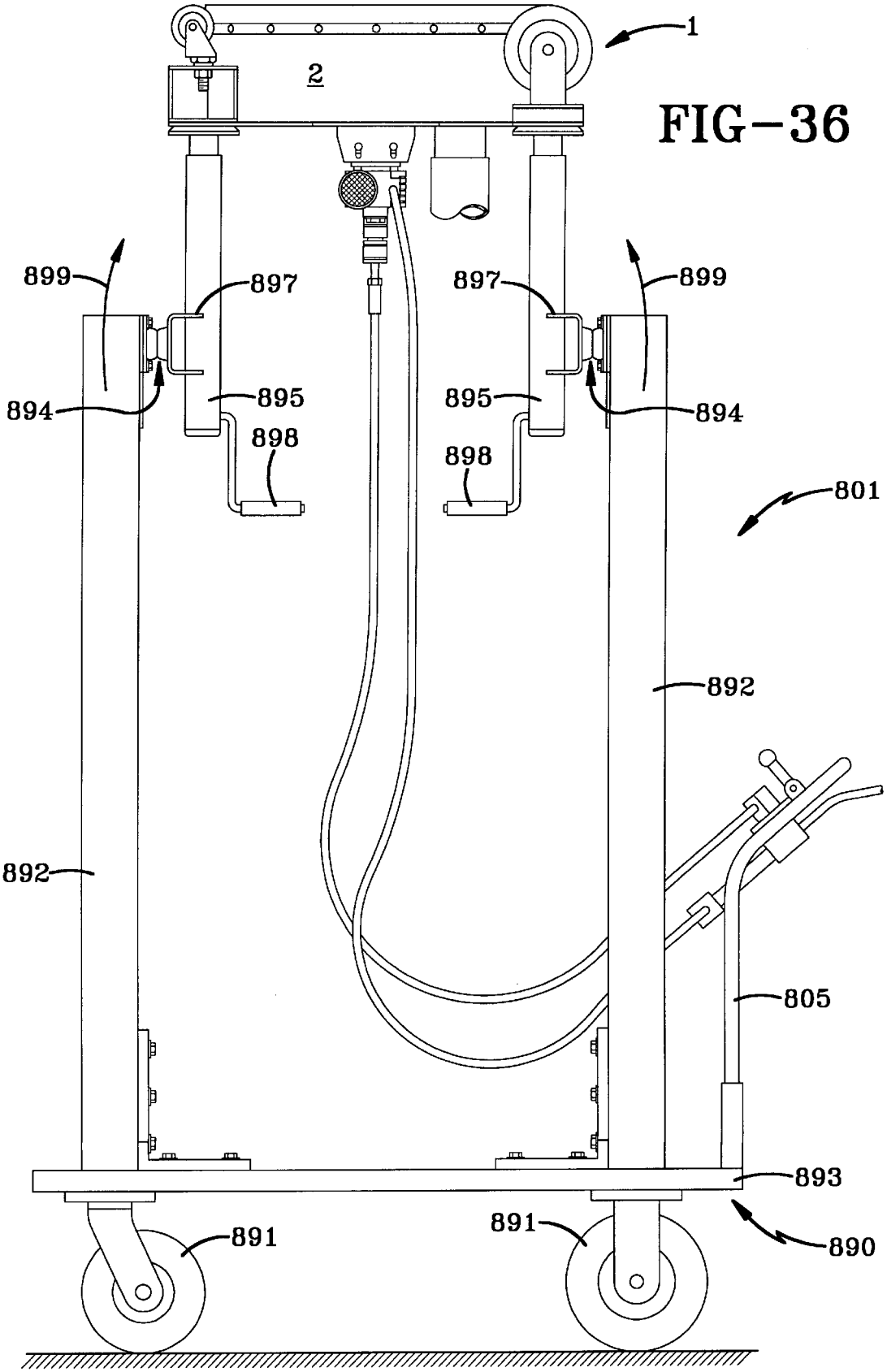
FIG. 36 is the same side elevational view of the high pressure cleaning and removal system of FIG. 35 except that the cleaning apparatus is rotated to an up position.
Figure 37:
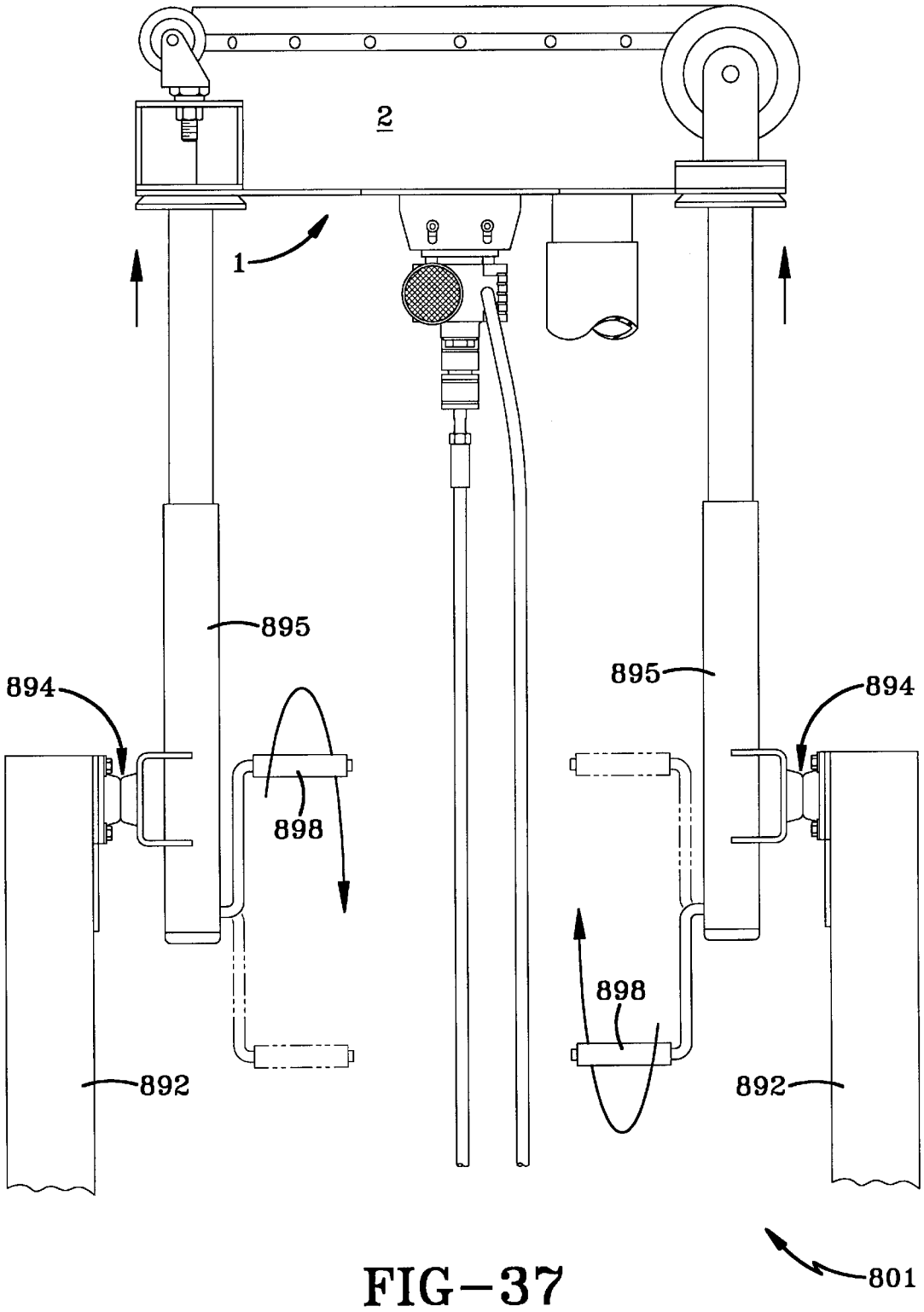
FIG. 37 is a fragmentary view of a portion of the cleaning apparatus in the high pressure cleaning and removal system of FIGS. 35 and 36.

A seventh embodiment of the high pressure cleaning and removal system is shown in FIGS. 35–37 and indicated generally as 801. This embodiment is for the cleaning of ceilings or other overhead surfaces. The system 801 includes a standard high pressure cleaning and removal system such as the one disclosed in FIGS. 1–11 where this system 1 is attached to a cart in a pivotable manner. Specifically, a cart 890 with wheels 891 has a pair of upright supports 892 extending outward from a base 893. At the uppermost ends of the upright supports 892 are swivels 894 which are connected to actuators 895 extending rigidly outward from housing 2 of system 1. The swivels allow the entire system 1 with actuators 895 to be pivoted about the swivels 894 in a 360 degree manner. Such pivoting is shown when FIGS. 35 and 36 are compared and further shown by arrows 896 in FIG. 36.

Each of the swivels 894 is rigidly fastened to the uppermost ends of upright supports 892 while including a bearing or other swivel mechanism 896 and a connector 897 selectively attachable to one of the actuators 895.

Furthermore, cranks 898 are provided on actuators 895 for actuating or otherwise moving housing 2 and system 1 by opening up each of actuators 895 as is shown in FIG. 37. This allows the system 1 to be elevated towards and into contact with the ceiling or other overhead surface to be cleaned.

The purpose of the embodiment shown in FIGS. 35 and 36 is that ceilings can be cleaned with a stable system, while allowing for the system to be collapsed or otherwise positioned in a reduced height manner so as to be able to move the entire system through doorways and other limited height areas. Specifically, the system as shown in FIG. 35 is capable of being moved through a doorway while the system as shown in FIGS. 36 and 37 is being opened up and prepared for ceiling surface cleaning.

Figure 38:
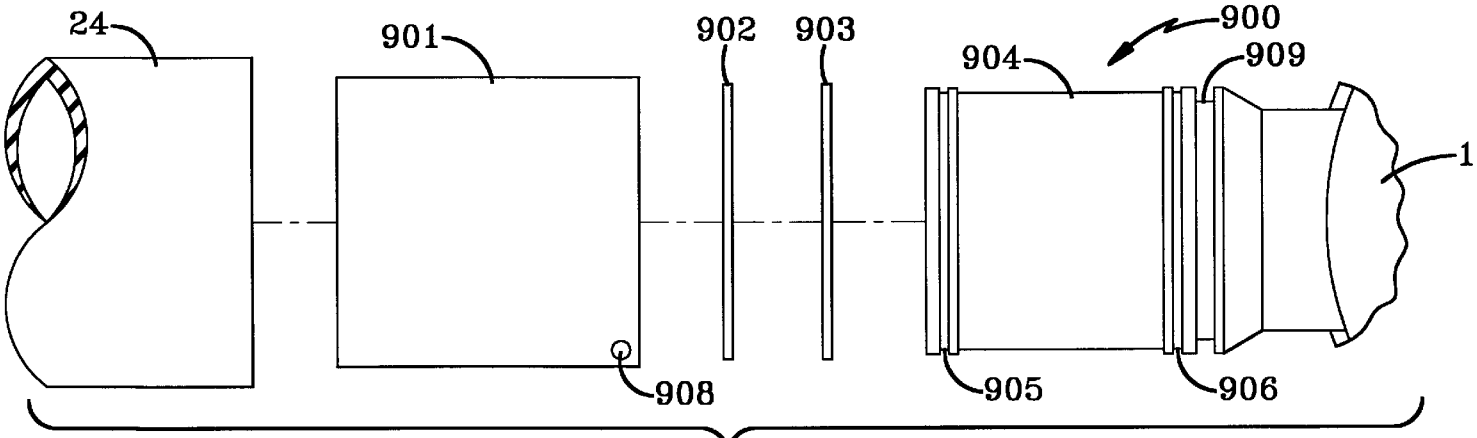
FIG. 38 is a fragmentary and exploded view of the coupling mechanism used to couple a hose to the cleaning and removal system.
Figure 39:
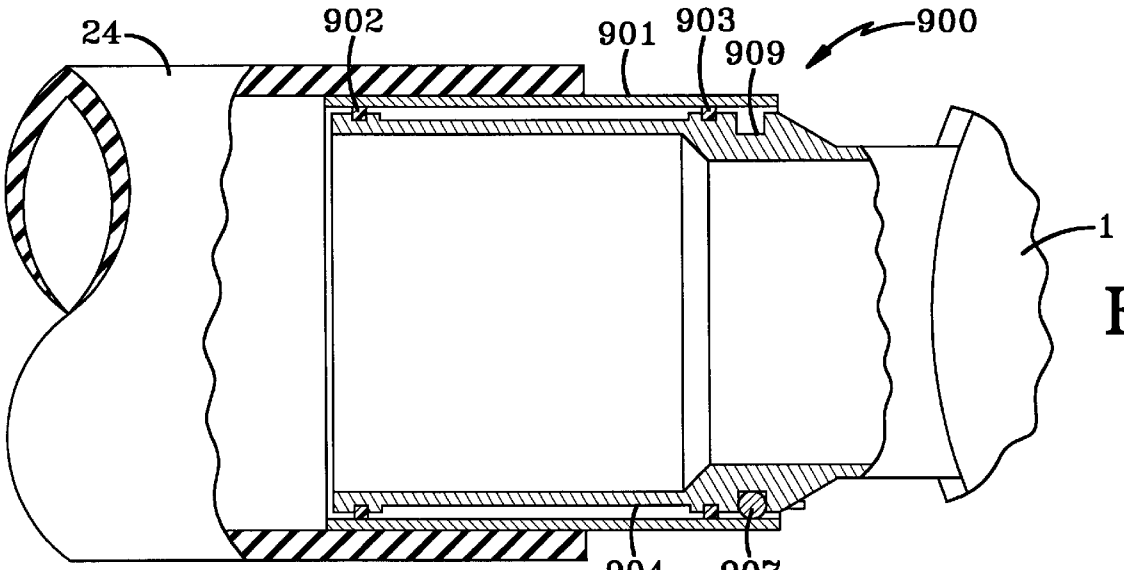
FIG. 39 is a fragmentary sectional view of the coupling mechanism of FIG. 38 when assembled.

In each of the above embodiments, a vacuum mechanism is used. The vacuum is generally remotely positioned away from the system. Therefore, a vacuum hose such as hose 24 is used to connect the vacuum supply (remotely located) with the system such as through funnel 23. So as to provide for an easy means of disconnecting the vacuum hose 24 from the system, a coupling 900 was designed as is shown in FIGS. 38 and 39.

The coupling 900 includes a sleeve 901, a pair of seals 902 and 903, and a special coupler 904 attached to the system such as system 1 as is shown in the Figures. Specifically, the special coupler 904 is attached at the end of the funnel 23 in system 1. Coupler 904 includes a pair of grooves 905 and 906 in which seals 902 and 903 are seated. Sleeve 901 is then fastened to hose 24 in a permanent manner. Sleeve 901 is then slid over coupler 904 such that a tight seal is formed by seals 902 and 903. Sleeve 901 is then held on coupler 904 by a pin 907 which is inserted through a hole 908 in sleeve 901. The pin engages a groove 909 in coupler 904 and allows for rotation of hose 24 and sleeve 901 about coupler 904 but prohibits axial withdraw therefrom. As a result, the hose 24 may rotate as needed during use but is not accidentally removable when pulled too hard. However, this design also allows for easy removal of the hose 24 when needed by merely removing pin 907 from hole 908 thereby disengaging pin 907 from groove 909. Specifically, pin 907 seats within groove 909 in a tangential manner.

Figure 40:
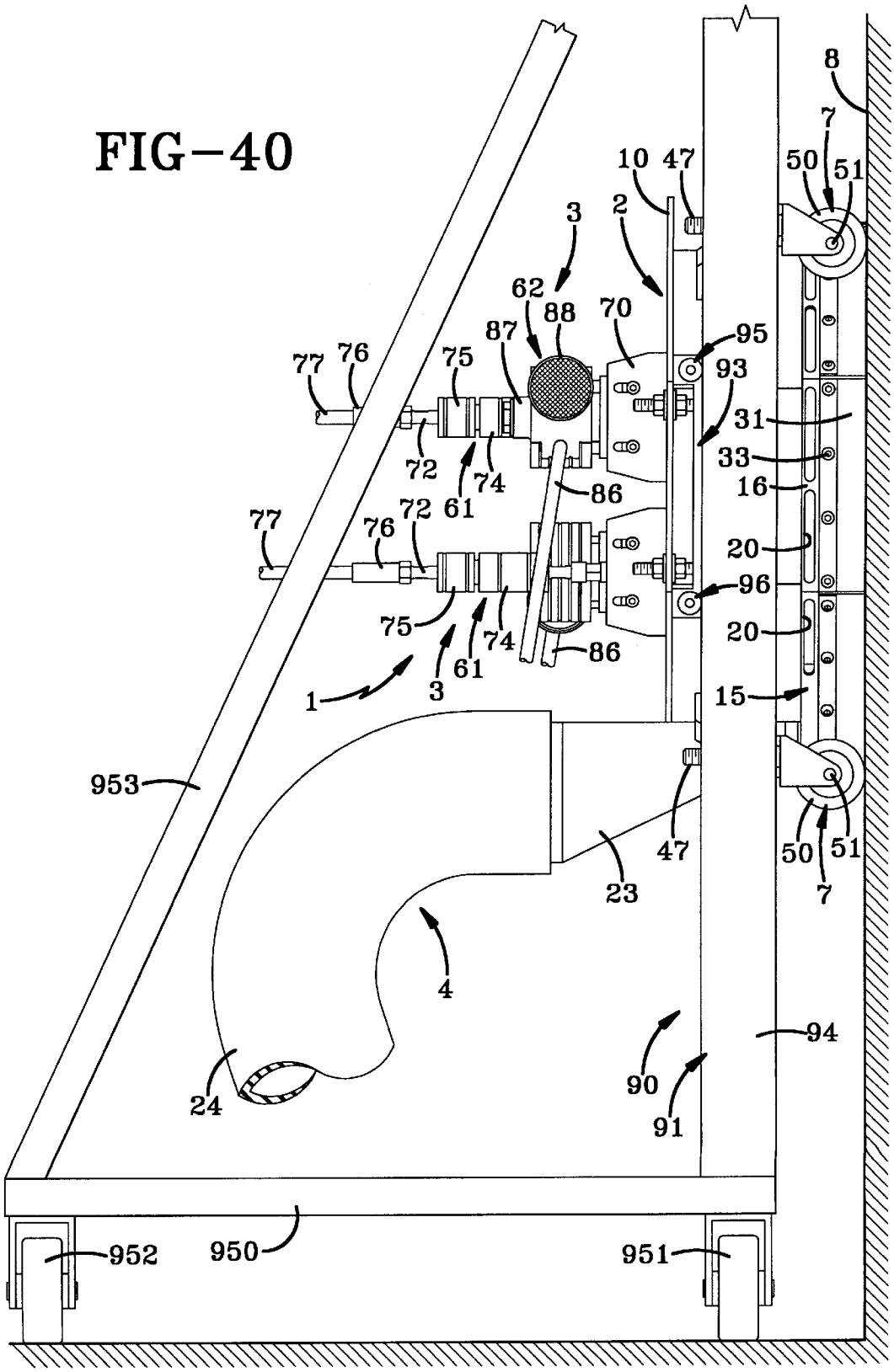
FIG. 40 is a side elevational view of a modified high pressure cleaning and removal system similar to that of FIG. 5 where system is attached to and movable within a wall track mechanism for vertical wall traversing and includes wheels so as to allow its movement along the wall in a horizontal manner.
Figure 41:
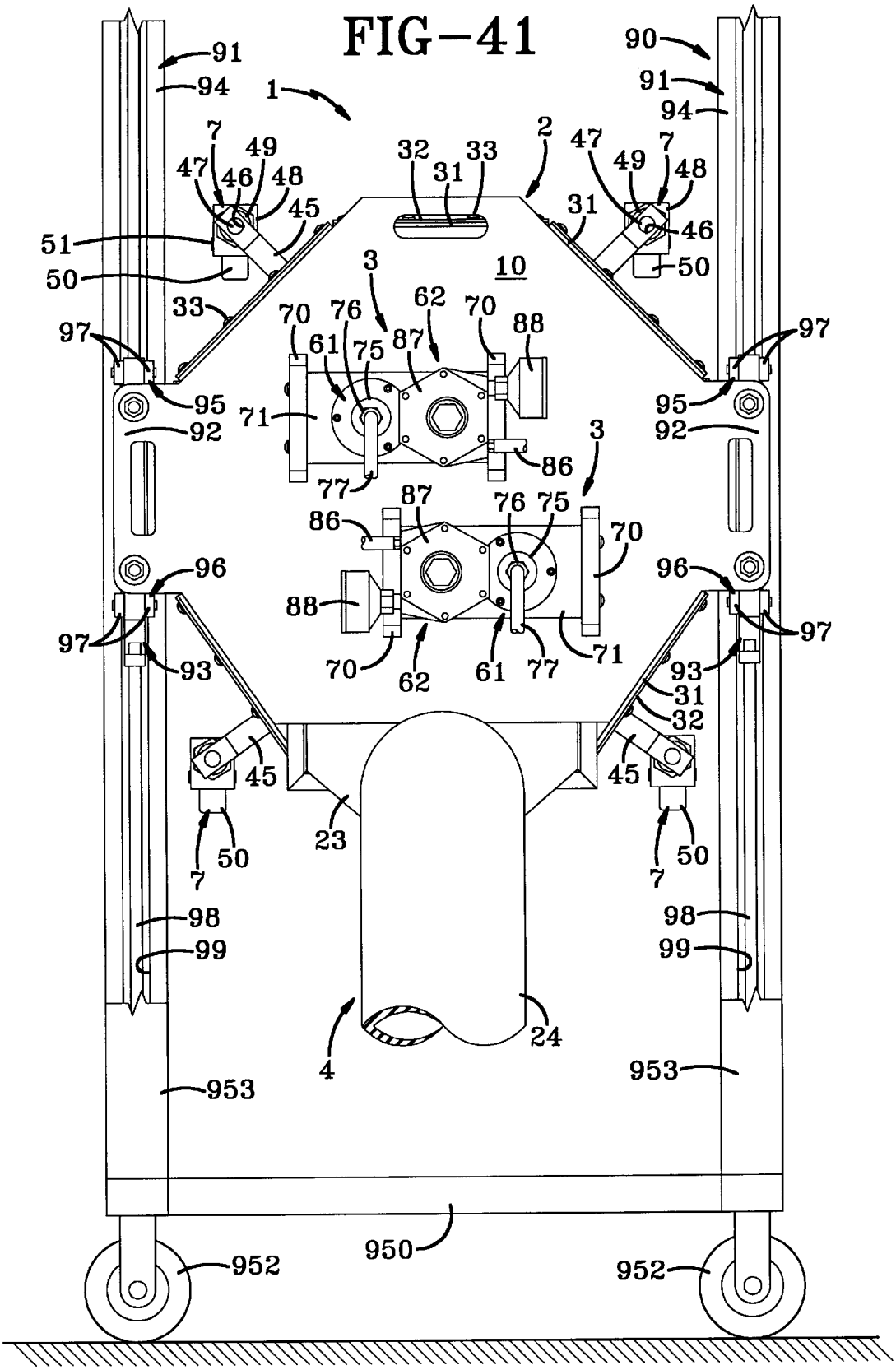
FIG. 41 is a further elevational view of the high pressure cleaning and removal system of FIG. 40 taken from above the housing.

Another embodiment of a system attachable to a track or rail system 90 so that the large housing 2 can be used vertically is shown in FIGS. 40 and 41 and has some similarities to the system shown in FIG. 9. In this embodiment of FIGS. 40 and 41, the housing 2 is affixed to tracks 91 in the same manner as in FIG. 9 so as to be vertically adjustable. However, the tracks 91 are also attached to a frame 950 that extends out from the wall to be cleaned so as to support the housing and the tracks in a stable manner. The frame 950 includes a pair of inner wheels 951 approximate the ends of the tracks 91 and at least one outer wheel 952 opposite thereof for allowing for horizontal movement of the entire assembly along the wall, the entire assembly including the track system 90, the housing 2, and the frame 950. Diagonal supports 953 are also provided for additional rigidity and support. This allows for the cleaning of walls or exterior surfaces on buildings whereby after one vertical swipe the system does not need to be disassembled or otherwise detached from the wall to be moved horizontally.

All of the above descried embodiments of surface cleaning devices and systems provide for effective surface cleaning and coating and buildup removal of hard, often porous, and generally unpermeable surfaces such as brick, concrete, limestone, masonry, stone, asphalt, etc. All of these devices are useful and effective for surface cleaning and coating and buildup removal using high pressure water, or non-caustic chemicals and then high pressure water applied via a number of different sized, shaped, and usage housings that include at least one rotating jet for applying the high pressure cleaning water that thereafter vacuumed out of the housing after cleaning by a high suction vacuum where the housing includes one or more rows of annular or peripheral sealing means such as brushes, rubber seals, rubber wipers, or other similar flexible yet sealing instruments.

In accordance with one of the features of the invention, the above device is used on aging and/or dirty buildings where there is a need to clean off years or decades of paint, asbestos, buildup, organic matter, mineral deposits, dirt, mold, mildew, debris, etc. The method of cleaning includes dispensing high pressure water from thefluid dispensing head within the housing for providing high pressure fluid flow against the surface to be cleaned and suctioning the water and any coatings, debris, and other matter that is removed from the surface out of the housing. In some cases, the method also includes pre-treating the surface with a chemical prior to dispensing high pressure water against the surface where the pre-treating step is performed with non-caustic chemicals including paint strippers.

During this process, the housing is either moved by the operator in the case of a hand held unit, or moved within a vertical track along a substantially vertical surface while dispensing and suctioning. In addition, the housing is periodically moved horizontally over the ground to align the housing with a vertically extending path to be cleaned.

As indicated above, it is sometimes necessary or desirable to pre-treat the surface with a non-caustic chemical to assist in material removal. This chemical is typically brushed, rolled or sprayed on and must be environmentally friendly or at least non-caustic. The chemical is then removed by the high pressure water bath whereby the chemical is washed and suctioned away via the housing and kept away from the environment. Examples of non-caustic chemical agents include non-caustic paint strippers and other surface preparation agents. Specific examples include AmeriStrip™ Gel as manufactured and sold by Safe Alternatives Corporation of America, Inc. and including N-Methylpyrrolidone, Dibasic Esters, POE Decyl Phosphate, Phosphoric Acid, Ethyl 3 Ethoxypropionate, Hydroxypropylcellulose and other ingredients, and Peel Away 7™ as manufactured and sold by Dumond Chemicals, Inc. and including Dibasic Ester, n-Methyl-2-pyrrolidone, Aluminum Silicate, Nonylphenol Ethoxylate, and nonhazardous ingredients.

Accordingly, the improved high pressure cleaning and removal method and system is simplified, provides an effective, safe, inexpensive, and efficient method and device which achieves all the enumerated objectives, provides for eliminating difficulties encountered with prior methods and devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved high pressure cleaning and removal system is constructed and used, the characteristics of the construction, and the advantageous, new and useful results obtained; the new and useful structures, devices, elements, arrangements, parts and combinations, are set forth in the appended claims.

We claim:

1. A method of cleaning aged or dirty buildings and structures made of brick, masonry, stone, block, limestone or other hard, yet porous, building materials so as to remove applied or built-up coatings and paints, mildew, mold, dirt, organic matter, stains, mineral deposits, debris and any other matter, the method comprising the steps of:

dispensing high pressure water from a fluid dispensing head within a housing for providing a high pressure fluid flow against a surface to be cleaned;

applying a reduced pressure to the housing from a vacuum source to vacuum the water and any coatings, debris, and other matter that is removed from the surface out of the housing;

moving the housing along a substantially vertical surface while dispensing and applying a reduced pressure to the housing; and moving the housing substantially horizontally along the vertical surface.

2. The method of cleaning dirt and paint from aged structures of claim 1 further comprising:

pre-treating the surface with a chemical prior to dispensing high pressure water against the surface.

3. The method of cleaning aged or dirty building and structures of claim 2 wherein the step of pre-treating the surface is performed with non-caustic chemicals.

4. The method of cleaning dirt and paint from aged structures of claim 3 wherein the non-caustic chemicals include paint strippers.

5. The method of cleaning aged or dirty buildings and structures of claim 1 wherein the housing includes a base and an inner wall and an outer wall extending obliquely from the base, the inner wall defining a cavity between the base and the surface to be cleaned, and the inner and outer walls defining a circumferential chamber about the cavity, whereby the high pressure water is dispensed from within the cavity while the application of the reduced pressure occurs in the circumferential chamber.

6. The method of cleaning aged or dirty buildings and structures of claim 5 wherein the circumferential chamber is fluidly connected to the cavity and an environment surrounding the housing.

7. The method of cleaning aged or dirty buildings and structures of claim 5 wherein the inner wall is spaced from the housing to form a gap therebetween such that the step of applying a reduced pressure to the housing includes the step of inducing fluid flow from the cavity, above the inner wall, and through the gap between the inner wall and the housing, the gap providing a fluid connection between the chamber and the cavity.

8. A method of cleaning aged or dirty buildings and structures made of brick, masonry, stone, block, limestone or other hard, yet porous, building materials so as to remove applied or built-up coatings and paints, mildew, mold, dirt, organic matter, stains, mineral deposits, debris and any other matter, the method comprising the steps of:

dispensing high pressure water from a fluid dispensing head within a housing for providing a high pressure fluid flow against a surface to be cleaned;

applying a reduced pressure to the housing from a vacuum source to vacuum the water and any coatings, debris, and other matter that is removed from the surface out of the housing;

moving the housing within a track along a non-horizontal surface while dispensing and applying a reduced pressure to the housing; and moving the housing over the ground to align the housing with a vertically extending path to be cleaned.

9. The method of cleaning aged or dirty buildings or structures of claim 8 wherein the step of moving the housing includes rolling the housing and the track over the ground.

10. A method of cleaning brick or masonry schools both inside and out so as to remove applied or built-up coatings and paints, mildew, mold, dirt, organic matter, stains, mineral deposits, debris and any other matter, the method comprising:

pre-treating a surface to be cleaned with a chemical;

dispensing high pressure water from a fluid dispensing head within a housing for providing a high pressure fluid flow against the surface to be cleaned;

applying a reduced pressure to the housing to vacuum the water, chemical, and any coatings, debris, and other matter that is removed from the surface out of the housing;

moving the housing along a substantially vertical surface while dispensing and applying a reduced pressure to the housing; and moving the housing horizontally along the vertical surface.

11. A method of cleaning brick or masonry schools both inside and out so as to remove applied or built-up coatings and paints, mildew, mold, dirt, organic matter, stains, mineral deposits, debris and any other matter, the method comprising the steps of:

pre-treating a surface to be cleaned with a chemical;

dispensing high pressure water from a fluid dispensing head within a housing for providing a high pressure fluid flow against the surface to be cleaned;

applying a reduced pressure to the housing to vacuum the water, chemical, and any coatings, debris, and other matter that is removed from the surface out of the housing;

moving the housing within a vertical track along a vertical surface while dispensing and applying a reduced pressure to the housing; and moving the housing and the track over the ground to align the housing with a vertically extending path to be cleaned.

* * * * *